US009570789B2

(12) United States Patent
Sherrer

(10) Patent No.: US 9,570,789 B2
(45) Date of Patent: Feb. 14, 2017

(54) TRANSITION STRUCTURE BETWEEN A RECTANGULAR COAXIAL MICROSTRUCTURE AND A CYLINDRICAL COAXIAL CABLE USING STEP CHANGES IN CENTER CONDUCTORS THEREOF

(71) Applicant: Nuvotronics, LLC, Radford, VA (US)

(72) Inventor: David Sherrer, Radford, VA (US)

(73) Assignee: NUVOTRONICS, INC, Radford, VA (US)

( * ) Notice: Subject to any disclaimer, the term of this patent is extended or adjusted under 35 U.S.C. 154(b) by 0 days.

(21) Appl. No.: 14/680,345

(22) Filed: Apr. 7, 2015

(65) Prior Publication Data

US 2016/0072171 A1 Mar. 10, 2016

Related U.S. Application Data

(63) Continuation of application No. 14/029,252, filed on Sep. 17, 2013, now Pat. No. 9,000,863, which is a continuation of application No. 13/015,671, filed on Jan. 28, 2011, now Pat. No. 8,542,079, which is a continuation of application No. 12/077,546, filed on Mar. 20, 2008, now Pat. No. 7,898,356.

(60) Provisional application No. 60/919,124, filed on Mar. 20, 2007.

(51) Int. Cl.

| | |
|---|---|
| ***H01P 5/02*** | (2006.01) |
| ***H01P 3/06*** | (2006.01) |
| ***H01P 11/00*** | (2006.01) |

(52) U.S. Cl.

CPC ..... *H01P 5/026* (2013.01); *H01P 3/06* (2013.01); *H01P 11/005* (2013.01); *Y10T 29/49016* (2015.01); *Y10T 29/49123* (2015.01)

(58) Field of Classification Search

CPC ..... H01P 3/06; H01P 5/022; H01P 11/005
USPC ..... 333/244, 245, 243, 34; 29/600
See application file for complete search history.

(56) References Cited

U.S. PATENT DOCUMENTS

| | | | |
|---|---|---|---|
| 2,743,505 | A | 5/1956 | Hill |
| 2,812,501 | A | 11/1957 | Sommers |
| 2,914,766 | A | 11/1959 | Butler |
| 2,997,519 | A | 8/1961 | Hines |
| 3,157,847 | A | 11/1964 | Williams |

(Continued)

FOREIGN PATENT DOCUMENTS

| | | | |
|---|---|---|---|
| CA | 2055116 | A1 | 5/1992 |
| DE | 3623093 | A1 | 1/1988 |

(Continued)

OTHER PUBLICATIONS

N. Ehsan, K.J. Vanhille, S. Rondineau, Z. Popovic, "Micro-coaxial impedance transformers," IEEE Trans. Microwave Theory Tech., Nov. 2010, pp. 2908-2914.

(Continued)

*Primary Examiner* — Benny Lee
(74) *Attorney, Agent, or Firm* — Neils Haun; Dann, Dorfman, Herrell and Skillman, P.C.

(57) ABSTRACT

Provided are coaxial transmission line microstructures formed by a sequential build process, and methods of forming such microstructures. The microstructures include a transition structure for transitioning between the coaxial transmission line and an electrical connector. The microstructures have particular applicability to devices for transmitting electromagnetic energy and other electronic signals.

9 Claims, 12 Drawing Sheets

(56) References Cited

U.S. PATENT DOCUMENTS

| | | | |
|---|---|---|---|
| 3,309,632 | A | 3/1967 | Trudeau |
| 3,311,966 | A | 4/1967 | Henry |
| 3,335,489 | A | 8/1967 | Grant |
| 3,352,730 | A | 11/1967 | Murch |
| 3,464,855 | A | 9/1969 | Quintana |
| 3,537,043 | A | 10/1970 | Smith |
| 3,560,896 | A | 2/1971 | Essinger |
| 3,577,105 | A | 5/1971 | Jones |
| 3,598,107 | A | 8/1971 | Ishikawa |
| 3,760,306 | A | 9/1973 | Spinner |
| 3,775,844 | A | 12/1973 | Parks |
| 3,789,129 | A | 1/1974 | Ditscheid |
| 3,791,858 | A | 2/1974 | McPherson |
| 3,884,549 | A | 5/1975 | Wang |
| 3,925,883 | A | 12/1975 | Cavalear |
| 3,963,999 | A | 6/1976 | Nakajima |
| 4,021,789 | A | 5/1977 | Furman |
| 4,075,757 | A | 2/1978 | Malm |
| 4,275,944 | A | 6/1981 | Sochor |
| 4,348,253 | A | 9/1982 | Subbarao |
| 4,365,222 | A | 12/1982 | Lampert |
| 4,414,424 | A | 11/1983 | Mizoguchi |
| 4,417,393 | A | 11/1983 | Becker |
| 4,437,074 | A | 3/1984 | Cohen |
| 4,521,755 | A | 6/1985 | Carlson |
| 4,581,301 | A | 4/1986 | Michaelson |
| 4,591,411 | A | 5/1986 | Reimann |
| 4,641,140 | A | 2/1987 | Heckaman |
| 4,663,497 | A | 5/1987 | Reimann |
| 4,673,904 | A | 6/1987 | Landis |
| 4,700,159 | A | 10/1987 | Jones |
| 4,729,510 | A | 3/1988 | Landis |
| 4,771,294 | A | 9/1988 | Wasilousky |
| 4,808,273 | A | 2/1989 | Hua |
| 4,832,461 | A | 5/1989 | Yamagishi |
| 4,853,656 | A | 8/1989 | Guillou |
| 4,856,184 | A | 8/1989 | Doeling |
| 4,857,418 | A | 8/1989 | Schuetz |
| 4,876,322 | A | 10/1989 | Budde |
| 4,880,684 | A | 11/1989 | Boss |
| 4,969,979 | A | 11/1990 | Appelt |
| 4,975,142 | A | 12/1990 | Iannacone |
| 5,069,749 | A | 12/1991 | Gutierrez |
| 5,072,201 | A | 12/1991 | Devaux |
| 5,100,501 | A | 3/1992 | Blumenthal |
| 5,119,049 | A | 6/1992 | Heller |
| 5,191,699 | A | 3/1993 | Ganslmeier |
| 5,227,013 | A | 7/1993 | Kumar |
| 5,235,208 | A | 8/1993 | Katoh |
| 5,274,484 | A | 12/1993 | Mochizuki |
| 5,334,956 | A | 8/1994 | Leding |
| 5,381,157 | A | 1/1995 | Shiga |
| 5,406,235 | A | 4/1995 | Hayashi |
| 5,406,423 | A | 4/1995 | Sato |
| 5,430,257 | A | 7/1995 | Lau |
| 5,454,161 | A | 10/1995 | Beilin |
| 5,622,895 | A | 4/1997 | Frank |
| 5,633,615 | A | 5/1997 | Quan |
| 5,682,062 | A | 10/1997 | Gaul |
| 5,682,124 | A | 10/1997 | Suski |
| 5,712,607 | A | 1/1998 | Dittmer |
| 5,724,012 | A | 3/1998 | Teunisse |
| 5,724,484 | A | 3/1998 | Kagami |
| 5,746,868 | A | 5/1998 | Abe |
| 5,793,272 | A | 8/1998 | Burghartz |
| 5,814,889 | A | 9/1998 | Gaul |
| 5,860,812 | A | 1/1999 | Gugliotti |
| 5,872,399 | A | 2/1999 | Lee |
| 5,925,206 | A | 7/1999 | Boyko |
| 5,940,674 | A | 8/1999 | Sachs |
| 5,961,347 | A | 10/1999 | Hsu |
| 5,977,842 | A | 11/1999 | Brown |
| 5,990,768 | A | 11/1999 | Takahashi |
| 6,008,102 | A | 12/1999 | Alford |
| 6,027,630 | A | 2/2000 | Cohen |
| 6,054,252 | A | 4/2000 | Lundy |
| 6,180,261 | B1 | 1/2001 | Inoue |
| 6,207,901 | B1 | 3/2001 | Smith |
| 6,210,221 | B1 | 4/2001 | Maury |
| 6,228,466 | B1 | 5/2001 | Tsukada |
| 6,232,669 | B1 | 5/2001 | Khoury |
| 6,294,965 | B1 | 9/2001 | Merrill |
| 6,350,633 | B1 | 2/2002 | Lin |
| 6,388,198 | B1 | 5/2002 | Bertin |
| 6,457,979 | B1 | 10/2002 | Dove |
| 6,465,747 | B2 | 10/2002 | DiStefano |
| 6,466,112 | B1 | 10/2002 | Kwon |
| 6,514,845 | B1 | 2/2003 | Eng |
| 6,518,165 | B1 | 2/2003 | Yoon |
| 6,535,088 | B1 | 3/2003 | Sherman |
| 6,589,594 | B1 | 7/2003 | Hembree |
| 6,600,395 | B1 | 7/2003 | Handforth |
| 6,603,376 | B1 | 8/2003 | Handforth |
| 6,648,653 | B2 | 11/2003 | Huang |
| 6,662,443 | B2 | 12/2003 | Chou |
| 6,677,248 | B2 | 1/2004 | Kwon |
| 6,735,009 | B2 | 5/2004 | Li |
| 6,746,891 | B2 | 6/2004 | Cunningham |
| 6,749,737 | B2 | 6/2004 | Cheng |
| 6,800,360 | B2 | 10/2004 | Miyanaga |
| 6,800,555 | B2 | 10/2004 | Test |
| 6,827,608 | B2 | 12/2004 | Hall |
| 6,850,084 | B2 | 2/2005 | Hembree |
| 6,888,427 | B2 | 5/2005 | Sinsheimer |
| 6,914,513 | B1 | 7/2005 | Wahlers |
| 6,917,086 | B2 | 7/2005 | Cunningham |
| 6,943,452 | B2 | 9/2005 | Bertin |
| 6,971,913 | B1 | 12/2005 | Chu |
| 6,975,267 | B2 | 12/2005 | Stenger |
| 6,981,414 | B2 | 1/2006 | Knowles |
| 7,005,750 | B2 | 2/2006 | Liu |
| 7,012,489 | B2 | 3/2006 | Sherrer |
| 7,030,712 | B2 | 4/2006 | Brunette |
| 7,064,449 | B2 | 6/2006 | Lin |
| 7,077,697 | B2 | 7/2006 | Kooiman |
| 7,084,722 | B2 | 8/2006 | Goyette |
| D530,674 | S | 10/2006 | Ko |
| 7,129,163 | B2 | 10/2006 | Sherrer |
| 7,148,141 | B2 | 12/2006 | Shim |
| 7,148,722 | B1 | 12/2006 | Cliff |
| 7,148,772 | B2 | 12/2006 | Sherrer |
| 7,165,974 | B2 | 1/2007 | Kooiman |
| 7,217,156 | B2 | 5/2007 | Wang |
| 7,222,420 | B2 | 5/2007 | Moriizumi |
| 7,239,219 | B2 | 7/2007 | Brown |
| 7,252,861 | B2 | 8/2007 | Smalley |
| 7,259,640 | B2 | 8/2007 | Brown |
| 7,388,388 | B2 | 6/2008 | Dong |
| 7,400,222 | B2 | 7/2008 | Kwon |
| 7,405,638 | B2 | 7/2008 | Sherrer |
| 7,449,784 | B2 | 11/2008 | Sherrer |
| 7,478,475 | B2 | 1/2009 | Hall |
| 7,508,065 | B2 | 3/2009 | Sherrer |
| 7,532,163 | B2 | 5/2009 | Chang |
| 7,555,309 | B2 | 6/2009 | Baldor |
| 7,575,474 | B1 | 8/2009 | Dodson |
| 7,579,553 | B2 | 8/2009 | Moriizumi |
| 7,602,059 | B2 | 10/2009 | Nobutaka |
| 7,619,441 | B1 | 11/2009 | Rahman |
| 7,649,432 | B2 | 1/2010 | Sherrer |
| 7,656,256 | B2 | 2/2010 | Houck |
| 7,658,831 | B2 | 2/2010 | Mathieu |
| 7,683,842 | B1 | 3/2010 | Engel |
| 7,705,456 | B2 | 4/2010 | Hu |
| 7,755,174 | B2 | 7/2010 | Rollin |
| 7,898,356 | B2 | 3/2011 | Sherrer |
| 7,948,335 | B2 | 5/2011 | Sherrer |
| 8,011,959 | B1 | 9/2011 | Tsai |
| 8,031,037 | B2 | 10/2011 | Sherrer |
| 8,188,932 | B2 | 5/2012 | Worl |
| 8,264,297 | B2 | 9/2012 | Thompson |
| 8,304,666 | B2 | 11/2012 | Ko |
| 8,339,232 | B2 | 12/2012 | Lotfi |
| 8,441,118 | B2 | 5/2013 | Hua |

(56) References Cited

U.S. PATENT DOCUMENTS

| | | | | |
|---|---|---|---|---|
| 8,522,430 | B2 | 9/2013 | Kacker | |
| 8,542,079 | B2 | 9/2013 | Sherrer | |
| 8,674,872 | B2 | 3/2014 | Billaud | |
| 8,742,874 | B2 | 6/2014 | Sherrer | |
| 8,814,601 | B1 | 8/2014 | Sherrer | |
| 9,000,863 | B2 * | 4/2015 | Sherrer | H01P 3/06 29/828 |
| 9,325,044 | B2 | 4/2016 | Reid | |
| 2002/0075104 | A1 | 6/2002 | Kwon | |
| 2003/0029729 | A1 | 2/2003 | Cheng | |
| 2003/0052755 | A1 | 3/2003 | Barnes | |
| 2003/0117237 | A1 | 6/2003 | Niu | |
| 2003/0221968 | A1 | 12/2003 | Cohen | |
| 2003/0222738 | A1 | 12/2003 | Brown | |
| 2004/0000701 | A1 | 1/2004 | White | |
| 2004/0004061 | A1 | 1/2004 | Merdan | |
| 2004/0007468 | A1 | 1/2004 | Cohen | |
| 2004/0007470 | A1 | 1/2004 | Smalley | |
| 2004/0038586 | A1 | 2/2004 | Hall | |
| 2004/0076806 | A1 | 4/2004 | Miyanaga | |
| 2004/0124961 | A1 | 7/2004 | Aoyagi | |
| 2004/0196112 | A1 | 10/2004 | Welbon | |
| 2004/0263290 | A1 | 12/2004 | Sherrer | |
| 2005/0030124 | A1 | 2/2005 | Okamoto | |
| 2005/0042932 | A1 | 2/2005 | Mok | |
| 2005/0045484 | A1 | 3/2005 | Smalley | |
| 2005/0156693 | A1 | 7/2005 | Dove | |
| 2005/0230145 | A1 | 10/2005 | Ishii | |
| 2005/0250253 | A1 | 11/2005 | Cheung | |
| 2008/0191817 | A1 | 8/2008 | Sherrer | |
| 2008/0197946 | A1 | 8/2008 | Houck | |
| 2008/0199656 | A1 | 8/2008 | Nichols | |
| 2008/0240656 | A1 | 10/2008 | Rollin | |
| 2009/0051476 | A1 | 2/2009 | Tada | |
| 2009/0154972 | A1 | 6/2009 | Tanaka | |
| 2010/0007016 | A1 | 1/2010 | Oppermann | |
| 2010/0015850 | A1 | 1/2010 | Stein | |
| 2010/0109819 | A1 | 5/2010 | Houck | |
| 2010/0225435 | A1 | 9/2010 | Li | |
| 2010/0296252 | A1 | 11/2010 | Rollin | |
| 2010/0323551 | A1 | 12/2010 | Eldridge | |
| 2011/0123783 | A1 | 5/2011 | Sherrer | |
| 2011/0123794 | A1 | 5/2011 | Hiller | |
| 2011/0181376 | A1 | 7/2011 | Vanhille | |
| 2011/0181377 | A1 | 7/2011 | Vanhille | |
| 2011/0210807 | A1 | 9/2011 | Sherrer | |
| 2011/0273241 | A1 | 11/2011 | Sherrer | |
| 2012/0233849 | A1 | 9/2012 | Smeys | |
| 2013/0050055 | A1 | 2/2013 | Paradiso | |
| 2013/0127577 | A1 | 5/2013 | Lotfi | |

FOREIGN PATENT DOCUMENTS

| | | | |
|---|---|---|---|
| EP | 0398019 | A1 | 11/1990 |
| EP | 0485831 | A1 | 5/1992 |
| EP | 0845831 | A2 | 6/1998 |
| EP | 0911903 | A2 | 4/1999 |
| FR | 2086327 | A1 | 12/1971 |
| GB | 2265754 | | 10/1993 |
| JP | H027587 | A | 1/1990 |
| JP | 3027587 | | 2/1991 |
| JP | H041710 | A | 1/1992 |
| JP | H0685510 | A | 3/1994 |
| JP | H06302964 | A | 10/1994 |
| JP | H07060844 | | 3/1995 |
| JP | H07235803 | | 9/1995 |
| JP | H10041710 | | 2/1998 |
| JP | 1998163711 | | 6/1998 |
| JP | 2002533954 | | 10/2002 |
| JP | 2003249731 | | 9/2003 |
| JP | 200667621 | | 3/2006 |
| JP | 2007253354 | | 10/2007 |
| JP | 2008211159 | | 9/2008 |
| JP | 2008306701 | | 12/2008 |
| TW | I244799 | | 12/2005 |
| WO | 0007218 | A2 | 2/2000 |
| WO | 0039854 | A1 | 7/2000 |
| WO | 0206152 | A2 | 1/2002 |
| WO | 02080279 | A1 | 10/2002 |
| WO | 04000406 | A1 | 12/2003 |
| WO | 2004004061 | | 1/2004 |
| WO | 2010111455 | | 9/2010 |

OTHER PUBLICATIONS

N. Ehsan, K. Vanhille, S. Rondineau, E. Cullens, Z. Popovic, "Broadband Wilkinson Dividers," IEEE Trans. Microwave Theory Tech., Nov. 2009, pp. 2783-2789.

Y. Saito, J.R. Mruk, J.-M. Rollin, D.S. Filipovic, "X- through Q-band log-periodic antenna with monolithically integrated u-coaxial impedance transformer/feeder," Electronic Letts. Jul. 2009, pp. 775-776.

M. V. Lukic, and D. S. Filipovic, "Surface-micromachined dual Ka-and cavity backed patch antenna," IEEE Trans. Antennas Propag., vol. 55, No. 7, pp. 2107-2110, Jul. 2007.

M. V. Lukic, and D. S. Filipovic, "Modeling of 3-D Surface Roughness Effects With Application to μ-Coaxial Lines," IEEE Trans. Microwave Theory Tech., Mar. 2007, pp. 518-525.

K. J. Vanhille, D. L. Fontaine, C. Nichols, D. S. Filipovic, and Z. Popovic, "Quasi-planar high-Q millimeter-wave resonators," IEEE Trans. Microwave Theory Tech., vol. 54, No. 6, pp. 2439-2446, Jun. 2006.

M. Lukic, S. Rondineau, Z. Popovic, D. Filipovic, "Modeling of realistic rectangular μ-coaxial lines," IEEE Trans. Microwave Theory Tech., vol. 54, No. 5, pp. 2068-2076, May 2006.

H. Zhou, N.A. Sutton, D. S. Filipovic, "W-band endfire log periodic dipole array," Proc. IEEE-APS/URSI Symposium, Spokane, WA, Jul. 2011, pp. 1233-1236.

T.E. Durham, "An 8-40GHz Wideband Instrument for Snow Measurements," Earth Science Technology Forum, Pasadena, CA, Jun. 2011.

J. M. Oliver, P. E. Ralston, E. Cullens, L. M. Ranzani, S. Raman, K. Vanhille, "A W-band Micro-coaxial Passive Monopulse Comparator Network with Integrated Cavity-Backed Patch Antenna Array," 2011 IEEE MTT-S Int. Microwave, Symp., Baltimore, MD, Jun. 2011.

H. Zhou, N. A. Sutton, D. S. Filipovic, "Wideband W-band patch antenna," 5th European Conference on Antennas and Propagation , Rome, Italy, Apr. 2011, pp. 1518-1521.

N. Sutton, D.S. Filipovic, "Design of a K- thru Ka-band modified Butler matrix feed for a 4-arm spiral antenna," 2010 Loughborough Antennas and Propagation Conference, Loughborough, UK, Nov. 2010, pp. 521-524.

E. Cullens, K. Vanhille, Z. Popovic, "Miniature bias-tee networks integrated in microcoaxial lines," in Proc. 40th European Microwave Conf., Paris, France, Sep. 2010, pp. 413-416.

D. Filipovic, G. Potvin, D. Fontaine, Y. Saito, J.-M. Rollin, Z. Popovic, M. Lukic, K. Vanhille, C. Nichols, "μ-coaxial phased arrays for Ka-Band Communications," Antenna Applications Symposium, Monticello, IL, Sep. 2008, pp. 104-115.

J.R. Reid, D. Hanna, R.T. Webster, "A 40/50 GHz diplexer realized with three dimensional copper micromachining," in 2008 IEEE MTT-S Int. Microwave Symp., Atlanta, GA, Jun. 2008, pp. 1271-1274.

A.A. Immorlica Jr., R. Actis, D. Nair, K. Vanhille, C. Nichols, J.-M. Rollin, D. Fleming, R. Varghese, D. Sherrer, D. Filipovic, E. Cullens, N. Ehsan, and Z. Popovic, "Miniature 3D micromachined solid state amplifiers," in 2008 IEEE International Conference on Microwaves, Communications, Antennas, and Electronic Systems, Tel-Aviv, Israel, May 2008, pp. 1-7.

M. Lukic, K. Kim, Y. Lee, Y. Saito, and D. S. Filipovic, "Multiphysics design and performance of a surface micromachined Ka-band cavity backed patch antenna," 2007 SBMO/IEEE Int. Microwave and Optoelectronics Conf., Oct. 2007, pp. 321-324.

M. V. Lukic, and D. S. Filipovic, "Integrated cavity-backed ka-band phased array antenna," Proc. IEEE-APS/URSI Symposium, Jun. 2007, pp. 133-135.

(56) References Cited

OTHER PUBLICATIONS

M. Lukic, D. Fontaine, C. Nichols, D. Filipovic, "Surface micromachined Ka-band phased array antenna," Presented at Antenna Applic. Symposium, Monticello, IL, Sep. 2006.
D. Filipovic, Z. Popovic, K. Vanhille, M. Lukic, S. Rondineau, M. Buck, G. Potvin, D. Fontaine, C. Nichols, D. Sherrer, S. Zhou, W. Houck, D. Fleming, E. Daniel, W. Wilkins, V. Sokolov, E. Adler, and J. Evans, "Quasi-planar rectangular ¼-coaxial structures for mm-wave applications," Proc. GomacTech., pp. 28-31, San Diego, Mar. 2006.
M. Lukic, D. Filipovic, "Modeling of surface roughness effects on the performance of rectangular μ-coaxial lines," Proc. 22nd Ann. Rev. Prog. Applied Comp. Electromag. (ACES), pp. 620-625, Miami, Mar. 2006.
J. R. Mruk, N. Sutton, D. S. Filipovic, "Micro-coaxial fed 18 to 110 GHz planar log-periodic antennas with RF transitions," IEEE Trans. Antennas Propag., vol. 62, No. 2, Feb. 2014, pp. 968-972.
N. Jastram, D. S. Filipovic, "PCB-based prototyping of 3-D micromachined RF subsystems," IEEE Trans. Antennas Propag., vol. 62, No. 1, Jan. 2014. pp. 420-429.
L. Ranzani, D. Kuester, K. J. Vanhille, A Boryssenko, E. Grossman, Z. Popovic, "G-Band micro-fabricated frequency-steered arrays with 2°/GHz beam steering," IEEE Trans. on Terahertz Science and Technology, vol. 3, No. 5, Sep. 2013.
L. Ranzani, E. D. Cullens, D. Kuester, K. J. Vanhille, E. Grossman, Z. Popovic, "W-band micro-fabricated coaxially-fed frequency scanned slot arrays," IEEE Trans. Antennas Propag., vol. 61, No. 4, Apr. 2013.
H. Zhou, N. A. Sutton, D. S. Filipovic, "Surface micromachined millimeter-wave log-periodic dipole array antennas," IEEE Trans. Antennas Propag., Oct. 2012, vol. 60, No. 10, pp. 4573-4581.
P. Ralston, M. Oliver, K. Vummidi, S. Raman, "Liquid-metal vertical interconnects for flip chip assembly of GaAs C-band power amplifiers onto micro-rectangular coaxial transmission lines," IEEE Journal of Solid-State Circuits, Oct. 2012, vol. 47, No. 10, pp. 2327-2334.
N.A. Sutton, J.M. Oliver, D.S. Filipovic, "Wideband 18-40 GHz surface micromachined branchline quadrature hybrid," IEEE Microwave and Wireless Components Letters, Sep. 2012, vol. 22, No. 9, pp. 462-464.
E. Cullens, L. Ranzani, K. Vanhille, E. Grossman, N. Ehsan, Z. Popovic, "Micro-Fabricated 130-180 GHz frequency scanning waveguide arrays," IEEE Trans. Antennas Propag., Aug. 2012, vol. 60, No. 8, pp. 3647-3653.
Mruk, J.R., Filipovic, D.S, "Micro-coaxial V-/W-band filters and contiguous diplexers," Microwaves, Antennas & Propagation, IET, Jul. 17, 2012, vol. 6, issue 10, pp. 1142-1148.
J. M. Oliver, J.-M. Rollin, K. Vanhille, S. Raman, "A W-band micromachined 3-D cavity-backed patch antenna array with integrated diode detector," IEEE Trans. Microwave Theory Tech., Feb. 2012, vol. 60, No. 2, pp. 284-292.
Mruk, J.R., Saito, Y., Kim, K., Radway, M., Filipovic, D.S., "Directly fed millimetre-wave two-arm spiral antenna," Electronics Letters, Nov. 25, 2010, vol. 46 , issue 24, pp. 1585-1587.
Y. Saito, M.V. Lukic, D. Fontaine, J.-M. Rollin, D.S. Filipovic, "Monolithically Integrated Corporate-Fed Cavity-Backed Antennas," IEEE Trans. Antennas Propag., vol. 57, No. 9, Sep. 2009, pp. 2583-2590.
Y. Saito, D. Fontaine, J.-M. Rollin, D.S. Filipovic, "Monolithic micro-coaxial power dividers," Electronic Letts., Apr. 2009, pp. 469-470.
D.S. Filipovic, M. Lukic, Y. Lee and D. Fontaine, "Monolithic rectangular coaxial lines and resonators with embedded dielectric support," IEEE Microwave and Wireless Components Letters, vol. 18, No. 11, pp. 740-742, 2008.
D. Sherrer, "Improving electronics\ functional density," MICROmanufacturing, May/Jun. 2015, pp. 16-18.
T. Durham, H.P. Marshall, L. Tsang, P. Racette, Q. Bonds, F. Miranda, K. Vanhille, "Wideband sensor technologies for measuring surface snow," Earthzine, Dec. 2013, [online: http://www.earthzine.org/2013/12/02/wideband-sensor-technologies-for-measuring-surface-snow/].
S. Huettner, "High Performance 3D Micro-Coax Technology," Microwave Journal, Nov. 2013. [online: http://www.microwavejournal.com/articles/21004-high-performance-3d-micro-coax-technology].
S. Huettner, "Transmission lines withstand vibration," Microwaves and RF, Mar. 2011. [online: http://mwrf.com/passive-components/transmission-lines-withstand-vibration].
Z. Popovic, S. Rondineau, D. Filipovic, D. Sherrer, C. Nichols, J.-M. Rollin, and K. Vanhille, "An enabling new 3D architecture for microwave components and systems," Microwave Journal, Feb. 2008, pp. 66-86.
"Shiffman phase shifters designed to work over a 15-45GHz range," phys.org, Mar. 2014. [online: http://phys.org/wire-news/156496085/schiffman-phase-shifters-designed-to-work-over-a-15-45ghz-range.html].
B. Cannon, K. Vanhille, "Microfabricated Dual-Polarized, W-band Antenna Architecture for Scalable Line Array Feed," 2015 IEEE Antenna and Propagation Symposium, Vancouver, Canada, Jul. 2015.
T. E. Durham, C. Trent, K. Vanhille, K. M. Lambert, F. A. Miranda, "Design of an 8-40 GHz Antenna for the Wideband Instrument for Snow Measurements (WISM)," 2015 IEEE Antenna and Propagation Symposium, Vancouver, Canada, Jul. 2015.
K. M. Lambert, F. A. Miranda, R. R. Romanofsky, T. E. Durham, K. J. Vanhille, "Antenna characterization for the Wideband Instrument for Snow Measurements (WISM)," 2015 IEEE Antenna and Propagation Symposium, Vancouver, Canada, Jul. 2015.
T. Liu, F. Houshmand, C. Gorle, S. Scholl, H. Lee, Y. Won, H. Kazemi, K. Vanhille, M. Asheghi, K. Goodson, "Full-Scale Simulation of an Integrated Monolithic Heat Sink for Thermal Management of a High Power Density GaN—SiC Chip," InterPACK/ICNMM, San Francisco, CA, Jul. 2015.
S. Scholl, C. Gorle, F. Houshmand, T. Liu, H. Lee, Y. Won, H. Kazemi, M. Asheghi, K. Goodson, "Numerical Simulation of Advanced Monolithic Microcooler Designs for High Heat Flux Microelectronics," InterPACK, San Francisco, CA, Jul. 2015.
S. Scholl, C. Gorle, F. Houshmand, T. Verstraete, M. Asheghi, K. Goodson, "Optimization of a microchannel geometry for cooling high heat flux microelectronics using numerical methods," InterPACK, San Francisco, CA, Jul. 2015.
K. Vanhille, T. Durham, W. Stacy, D. Karasiewicz, A. Caba, C. Trent, K. Lambert, F. Miranda, "A microfabricated 8-40 GHz dual-polarized reflector feed," 2014 Antenna Applications Symposium, Monticello, IL, Sep. 2014. pp. 241-257.
A. Boryssenko, J. Arroyo, R. Reid, M.S. Heimbeck, "Substrate free G-band Vivaldi antenna array design, fabrication and testing" 2014 IEEE International Conference on Infrared, Millimeter, and Terahertz Waves, Tucson, Sep. 2014.
A. Boryssenko, K. Vanhille, "300-GHz microfabricated waveguide slotted arrays" 2014 IEEE International Conference on Infrared, Millimeter, and Terahertz Waves, Tucson, Sep. 2014.
N. Chamberlain, M. Sanchez Barbetty, G. Sadowy, E. Long, K. Vanhille, "A dual-polarized metal patch antenna element for phased array applications," 2014 IEEE Antenna and Propagation Symposium, Memphis, Jul. 2014. pp. 1640-1641.
L. Ranzani, I. Ramos, Z. Popovic, D. Maksimovic, "Microfabricated transmission-line transformers with DC isolation," URSI National Radio Science Meeting, Boulder, CO, Jan. 2014.
N. Jastram, D. S. Filipovic, "Parameter study and design of W-band micromachined tapered slot antenna," Proc. IEEE-APS/URSI Symposium, Orlando, FL, Jul. 2013, pp. 434-435.
J.M. Oliver, H. Kazemi, J.-M. Rollin, D. Sherrer, S. Huettner, S. Raman, "Compact, low-loss, micromachined rectangular coaxial millimeter-wave power combining networks," 2013 IEEE MTT-S Int. Microwave, Symp., Seattle, WA, Jun. 2013.
N. Jastram, D. Filipovic, "Monolithically integrated K/Ka array-based direction finding subsystem," Proc. IEEE-APS/URSI Symposium, Chicago, IL, Jul. 2012, pp. 1-2.

(56) References Cited

OTHER PUBLICATIONS

N.A. Sutton, D. S. Filipovic, "V-band monolithically integrated four-arm spiral antenna and beamforming network," Proc. IEEE-APS/URSI Symposium, Chicago, IL, Jul. 2012, pp. 1-2.
P. Ralston, K. Vanhille, A. Caba, M. Oliver, S. Raman, "Test and verification of micro coaxial line power performance," 2012 IEEE MTT-S Int. Microwave, Symp., Montreal, Canada, Jun. 2012.
N.A. Sutton, J. M. Oliver, D. S. Filipovic, "Wideband 15-50 GHz symmetric multi-section coupled line quadrature hybrid based on surface micromachining technology," 2012 IEEE MTT-S Int. Microwave, Symp., Montreal, Canada, Jun. 2012.
J.R. Reid, J.M. Oliver, K. Vanhille, D. Sherrer, "Three dimensional metal micromachining: A disruptive technology for millimeter-wave filters," 2012 IEEE Topical Meeting on Silicon Monolithic Integrated Circuits in RF Systems, Jan. 2012.
P. Ralston, M. Oliver, K. Vummidi, S. Raman, "Liquid-metal vertical interconnects for flip chip assembly of GaAs C-band power amplifiers onto micro-rectangular coaxial transmission lines," IEEE Compound Semiconductor Integrated Circuit Symposium, Oct. 2011.
J.R. Mruk, Y. Saito, K. Kim, M. Radway, D. Filipovic, "A directly fed Ku- to W-band 2-arm Archimedean spiral antenna," Proc. 41st European Microwave Conf., Oct. 2011, pp. 539-542.
E. Cullens, L. Ranzani, E. Grossman, Z. Popovic, "G-Band Frequency Steering Antenna Array Design and Measurements," Proceedings of the XXXth URSI General Assembly, Istanbul, Turkey, Aug. 2011.
J. R. Mruk, H. Zhou, H. Levitt, D. Filipovic, "Dual wideband monolithically integrated millimeter-wave passive front-end subsystems," in 2010 Int. Conf. on Infrared, Millimeter and Terahertz Waves , Sep. 2010, pp. 1-2.
Z. Popovic, "Micro-coaxial micro-fabricated feeds for phased array antennas," in IEEE Int. Symp. on Phased Array Systems and Technology, Waltham, MA, Oct. 2010, pp. 1-10. (Invited).
L. Ranzani, N. Ehsan, Z. Popovi‡, , "G-band frequency-scanned antenna arrays," 2010 IEEE APS-URSI International Symposium, Toronto, Canada, Jul. 2010.
J. Mruk, Z. Hongyu, M. Uhm, Y. Saito, D. Filipovic, "Wideband mm-Wave Log-Periodic Antennas," 3rd European Conference on Antennas and Propagation, pp. 2284-2287, Mar. 2009.
Z. Popovic, K. Vanhille, N. Ehsan, E. Cullens, Y. Saito, J.-M. Rollin, C. Nichols, D. Sherrer, D. Fontaine, D. Filipovic, "Micro-fabricated micro-coaxial millimeter-wave components," in 2008 Int. Conf. on Infrared, Millimeter and Terahertz Waves, Pasadena, CA, Sep. 2008, pp. 1-3.
K. Vanhille, M. Lukic, S. Rondineau, D. Filipovic, and Z. Popovic, "Integrated micro-coaxial passive components for millimeter-wave antenna front ends," 2007 Antennas, Radar, and Wave Propagation Conference, May 2007.
D. Filipovic, G. Potvin, D. Fontaine, C. Nichols, Z. Popovic, S. Rondineau, M. Lukic, K. Vanhille, Y. Saito, D. Sherrer, W. Wilkins, E. Daniels, E. Adler, and J. Evans, "Integrated micro-coaxial Ka-band antenna and array," GomacTech 2007 Conference, Mar. 2007.
K. Vanhille, M. Buck, Z. Popovic, and D.S. Filipovic, "Miniature Ka-band recta-coax components: analysis and design," presented at 2005 AP-S/URSI Symposium, Washington, DC, Jul. 2005.
K. Vanhille, "Design and Characterization of Microfabricated Three-Dimensional Millimeter-Wave Components," Thesis, 2007.
N. Ehsan, "Broadband Microwave Lithographic 3D Components," Thesis, 2009.
J. Oliver, "3D Micromachined Passive Components and Active Circuit Integration for Millimeter-Wave Radar Applications," Thesis, Feb. 10, 2011.
J. Mruk, "Wideband Monolithically Integrated Front-End Subsystems and Components," Thesis, 2011.
E. Cullens, "Microfabricated Broadband Components for Microwave Front Ends," Thesis, 2011.
N. Jastram, "Design of a Wideband Millimeter Wave Micromachined Rotman Lens," IEEE Transactions on Antennas and Propagation, vol. 63, No. 6, Jun. 2015.
N. Jastram, "Wideband Millimeter-Wave Surface Micromachined Tapered Slot Antenna," IEEE Antennas and Wireless Propagation Letters, vol. 13, 2014.
H. Kazemi, "350mW G-band Medium Power Amplifier Fabricated Through a New Method of 3D-Copper Additive Manufacturing," IEEE 2015.
H. Kazemi, "Ultra-compact G-band 16way Power Splitter/Combiner Module Fabricated Through a New Method of 3D-Copper Additive Manufacturing," IEEE 2015.
N. Jastram, "Wideband Multibeam Millimeter Wave Arrays," IEEE 2014.
J. Reid, "PolyStrata Millimeter-wave Tunable Filters," GOMACTech-12, Mar. 22, 2012.
"Multiplexer/LNA Module using PolyStrata®," GOMACTech-15, Mar. 26, 2015.
Ali Darwish et al.; Vertical Balun and Wilkinson Divider; 2002 IEEE MTT-S Digest; pp. 109-112.
Brown et al., 'A Low-Loss Ka-Band Filter in Rectangular Coax Made by Electrochemical Fabrication', submitted to Microwave and Wireless Components Letters, date unknown {downloaded from www.memgen.com, 2004).
Chance, G.I. et al., "A suspended-membrane balanced frequency doubler at 200GHz," 29th International Conference on Infrared and Millimeter Waves and Terahertz Electronics, pp. 321-322, Karlsrube, 2004.
Chwomnawang et al., 'On-chip 3D Air Core Micro-Inductor for High-Frequency Applications Using Deformation of Sacrificial Polymer', Proc. SPIE, vol. 4334, pp. 54-62, Mar. 2001.
Colantonio, P., et al., "High Efficiency RF and Microwave Solid State Power Amplifiers," pp. 380-395, 2009.
Cole, B.E., et al., Micromachined Pixel Arrays Integrated with CMOS for Infrared Applications, pp. 64-64 (2000).
De Los Santos, H.J., Introduction to Microelectromechanical (MEM) Microwave Systems {pp. 4, 7-8, 13) (1999).
Deyong, C, et al., A Microstructure Semiconductor Thermocouple for Microwave Power Sensors, 1997 Asia Pacific Microwave Conference, pp. 917-919.
Ehsan, N., "Broadband Microwave Litographic 3D Components," Dissertation 2009.
Ehsan, N. et al., "Microcoaxial lines for active hybrid-monolithic circuits," 2009 IEEE MTT-S Int. Microwave.Symp. Boston, MA, Jun. 2009.
Elliott Brown/MEMGen Corporation, 'RF Applications of EFAB Technology', MTT-S IMS 2003, pp. 1-15.
Engelmann et al., 'Fabrication of High Depth-to-Width Aspect Ratio Microstructures', IEEE Micro Electro Mechanical Systems (Feb. 1992), pp. 93-98.
European Examination Report dated Mar. 21, 2013 for EP Application No. 07150463.3.
European Examination Report of corresponding European Patent Application No. 08 15 3144 dated Apr. 6, 2010.
European Examination Report of corresponding European Patent Application No. 08 15 3144 dated Feb. 22, 2012.
European Examination Report of corresponding European Patent Application No. 08 15 3144 dated Nov. 10, 2008.
European Search Report for corresponding EP Application No. 07150463.3 dated Apr. 23, 2012.
European Search Report of Corresponding European Application No. 07 15 0467 mailed Apr. 28, 2008.
European Search Report of corresponding European Application No. 08 15 3138 mailed Jul. 15, 2008.
European Search Report of corresponding European Patent Application No. 08 15 3144 dated Jul. 2, 2008.
Filipovic, D. et al., "Monolithic rectangular coaxial lines. Components and systems for commercial and defense applications," Presented at 2008 IASTED Antennas, Radar, and Wave Propagation Conferences, Baltimore, MD, USA, Apr. 2008.
Filipovic, D.S., "Design of microfabricated rectangular coaxial lines and components for mm-wave applications," Microwave Review, vol. 12, No. 2, Nov. 2006, pp. 11-16.

(56) References Cited

OTHER PUBLICATIONS

Filipovic et al.; 'Modeling, Design, Fabrication, and Performance of Rectangular .mu.-Coaxial Lines and Components'; Microwave Symposium Digest, 2006, IEEE; Jun. 1, 2006; pp. 1393-1396.
Franssila, S., Introduction to Microfabrication, (pp. 8) (2004).
Frazier et al., 'M Et ALlic Microstructures Fabricated Using Photosensitive Polyimide Electroplating Molds', Journal of Microelectromechanical Systems, vol. 2, No. 2, Jun. 1993, pp. 87-94.
Ghodisian, B., et al., Fabrication of Affordable M Et ALlic Microstructures by Electroplating and Photoresist Molds, 1996, pp. 68-71.
H. Guckel, 'High-Aspect-Ratio Micromachining Via Deep X-Ray Lithography', Proc. of IEEE, vol. 86, No. 8 (Aug. 1998), pp. 1586-1593.
Hawkins, C.F., The Microelectronics Failure Analysis, Desk Reference Edition (2004).
Immorlica, Jr., T. et al., "Miniature 3D micro-machined solid state power amplifiers," COMCAS 2008.
Ingram, D.L. et al., "A 427 mW 20% compact W-band InP HEMT MMIC power amplifier," IEEE RFIC Symp. Digest 1999, pp. 95-98.
International Preliminary Report on Patentability dated Jul. 24, 2012 for corresponding PCT/US2011/022173.
International Preliminary Report on Patentability dated May 19, 2006 on corresponding PCT/US04/06665.
International Search Report corresponding to PCT/US12/46734 dated Nov. 20, 2012.
International Search Report dated Aug. 29, 2005 on corresponding PCT/US04/06665.
Jeong, I., et al., "High Performance Air-Gap Transmission Lines and Inductors for Milimeter-Wave Applications", Transactions on Microwave Theory and Techniques, vol. 50, No. 12, Dec. 2002.
Jeong, Inho et al., 'High-Performance Air-Gap Transmission Lines and Inductors for Millimeter-Wave Applications', IEEE Transactions on Microwave Theory and Techniques, Dec. 2002, pp. 2850-2855, vol. 50, No. 12.
Katehi et al., 'MEMS and Si Micromachined Circuits for High-Frequency Applications', IEEE Transactions on Microwave Theory and Techniques, vol. 50, No. 3, Mar. 2002, pp. 858-866.
Kenneth J. Vanhille et al.; Micro-Coaxial Imedance Transformers; Journal of Latex Class Files; vol. 6; No. 1; Jan. 2007.
Kwok, P.Y., et al., Fluid Effects in Vibrating Micromachined Structures, Journal of Microelectromechanical Systems, vol. 14, No. 4, Aug. 2005, pp. 770-781.
Lee et al., 'Micromachining Applications of a High Resolution Ultrathick Photoresist', J. Vac. Sci. Technol. B 13 (6), Nov./Dec. 1995, pp. 3012-3016.
Loechel et al., 'Application of Ultraviolet Depth Lithography for Surface Micromachining', J. Vac. Sci. Technol. B 13 (6), Nov./Dec. 1995, pp. 2934-2939.
Lukic, M. et al., "Surface-micromachined dual Ka-band cavity backed patch antennas," IEEE Trans. AtennasPropag., vol. 55, pp. 2107-2110, Jul. 2007.
Madou, M.J., Fundamentals of Microfabrication: The Science of Miniaturization, 2d Ed., 2002 (Roadmap; pp. 615-668).
Oliver, J.M. et al., "A 3-D micromachined W-band cavity backed patch antenna array with integrated rectacoax transition to wave guide," 2009 Proc. IEEE International Microwave Symposium, Boston, MA 2009.
Park et al., 'Electroplated Micro-Inductors and Micro-Transformers for Wireless application', IMAPS 2002, Denver, CO, Sep. 2002.
PwrSoC Update 2012: Technology, Challenges, and Opportunities for Power Supply on Chip, Presentation (Mar. 18, 2013).
Rollin, J.M. et al., "A membrane planar diode for 200GHz mixing applications," 29th International Conference on Infrared and Millimeter Waves and Terahertz Electronics, pp. 205-206, Karlsrube, 2004.
Rollin, J.M. et al., "Integrated Schottky diode for a sub-harmonic mixer at millimetre wavelengths," 31st International Conference on Infrared and Millimeter Waves and Terahertz Electronics, Paris, 2006.
Saito, Y., Fontaine, D., Rollin, J-M., Filipovic, D., 'Micro-Coaxial Ka-Band Gysel Power Dividers,' Microwave Opt Technol Lett 52: 474-478, 2010, Feb. 2010.
Saito et al., "Analysis and design of monolithic rectangular coaxial lines for minimum coupling," IEEE Trans. Microwave Theory Tech., vol. 55, pp. 2521-2530, Dec. 2007.
Sedky, S., Post-Processing Techniques for Integrated MEMS (pp. 9, 11, 164) (2006).
Sherrer, D, Vanhille, K, Rollin, J.M., 'PolyStrata Technology: A Disruptive Approach for 3D Microwave Components and Modules,' Presentation (Apr. 23, 2010).
Tummala et al.; 'Microelectronics Packaging Handbook'; Jan. 1, 1989; XP002477031; pp. 710-714.
Vanhille, K., 'Design and Characterization of Microfabricated Three-Dimensional Millimeter-Wave Components,' Dissertation, 2007.
Vanhille, K. et al., 'Balanced low-loss Ka-band -coaxial hybrids,' IEEE MTT-S Dig., Honolulu, Hawaii, Jun. 2007.
Vanhille, K. et al., "Ka-Band surface mount directional coupler fabricated using micro-rectangular coaxial transmission lines," 2008 Proc. IEEE International Microwave Symposium, 2008.
Vanhille, K.J. et al., "Ka-band miniaturized quasi-planar high-Q resonators," IEEE Trans. Microwave Theory Tech., vol. 55, No. 6, pp. 1272-1279, Jun. 2007.
Vyas R. et al., "Liquid Crystal Polymer (LCP): The ultimate solution for low-cost RF flexible electronics and antennas," Antennas and Propagation Society, International Symposium, p. 1729-1732 (2007).
Wang, H. et al., "Design of a low integrated sub-harmonic mixer at 183GHz using European Schottky diode technology," From Proceedings of the 4th ESA workshop on Millimetre-Wave Technology and Applications, pp. 249-252, Espoo, Finland, Feb. 2006.
Wang, H. et al., "Power-amplifier modules covering 70-113 GHz using MMICs," IEEE Trans Microwave Theory and Tech., vol. 39, pp. 9-16, Jan. 2001.
Written Opinion corresponding to PCT/US12/46734 dated Nov. 20, 2012.
Written Opinion of the International Searching Authority dated Aug. 29, 2005 on corresponding PCT/US04/06665.
Yeh, J.L., et al., Copper-Encapsulated Silicon Micromachined Structures, Journal of Microelectromechanical Systems, vol. 9, No. 3, Sep. 2000, pp. 281-287.
Yoon et al., '3-D Lithography and M et al Surface Micromachining for RF and Microwave MEMS' IEEE MEMS 2002 Conference, Las Vegas, NV, Jan. 2002, pp. 673-676.
Yoon et al., 'CMOS-Compatible Surface Micromachined Suspended-Spiral Inductors for Multi-GHz Sillicon RF Ics', IEEE Electron Device Letters, vol. 23, No. 10, Oct. 2002, pp. 591-593.
Yoon et al., 'High-Performance Electroplated Solenoid-Type Integrated Inductor (SI2) for RF Applications Using Simple 3D Surface Micromachining Technology', Int'l Election Devices Meeting, 1998, San Francisco, CA, Dec. 6-9, 1998, pp. 544-547.
Yoon et al., 'High-Performance Three-Dimensional On-Chip Inductors Fabricated by Novel Micromachining Technology for RF MMIC', 1999 IEEE MTT-S Int'l Microwave Symposium Digest, vol. 4, Jun. 13-19, 1999, Anaheim, California, pp. 1523-1526.
Yoon et al., 'Monolithic High-Q Overhang Inductors Fabricated on Silicon and Glass Substrates', International Electron Devices Meeting, Washington D.C. (Dec. 1999), pp. 753-756.
Yoon et al., 'Monolithic Integration of 3-D Electroplated Microstructures with Unlimited Number of Levels Using Planarization with a Sacrificial M Et ALlic Mole (PSMm)', Twelfth IEEE Int'l Conf. on Micro Electro mechanical systems, Orlando Florida, Jan. 1999, pp. 624-629.
Yoon et al., 'Multilevel Microstructure Fabrication Using Single-Step 3D Photolithography and Single-Step Electroplating', Proc. of SPIE, vol. 3512, (Sep. 1998), pp. 358-366.
Yoon et al., "High-Performance Electroplated Solenoid-Type Integrated Inductor (S12) for RF Applications Using Simple 3D Surface

(56) References Cited

OTHER PUBLICATIONS

Micromachining Technology", Int'l Election Devices Meeting, 1998, San Francisco, CA, Dec. 6-9, 1998, pp. 544-547.
European Examination Report of EP App. No. 07150463.3 dated Feb. 16, 2015.
Horton, M.C., et al., "The Digital Elliptic Filter—A Compact Sharp-Cutoff Design for Wide Bandstop or Bandpass Requirements," IEEE Transactions on Microwave Theory and Techniques, (1967) MTT-15:307-314.
Extended EP Search Report for EP Application No. 12811132.5 dated Feb. 5, 2016.
International Search Report and Written Opinion for PCT/US2015/063192 dated May 20, 2016.
International Search Report and Written Opinion for PCT/US2015/011789 dated Apr. 10, 2015.
Derwent Abstract Translation of WO-2010-011911 A2 (published 2010).

* cited by examiner

TRANSITION STRUCTURE BETWEEN A RECTANGULAR COAXIAL MICROSTRUCTURE AND A CYLINDRICAL COAXIAL CABLE USING STEP CHANGES IN CENTER CONDUCTORS THEREOF

This application is a continuation of pending U.S. patent application Ser. No. 14/029,252, filed on Sep. 17, 2013 now U.S. Pat. No. 9,000,063, which is a continuation of U.S. patent application Ser. No. 13/015,671, filed on Jan. 28, 2011 now U.S. Pat. No. 8,542,079, which is a continuation of U.S. patent application Ser. No. 12/077,546, filed Mar. 20, 2008 now U.S. Pat. No. 7,898,356, which claims the benefit of priority under 35 U.S.C. §119(e) to U.S. Provisional Application No. 60/919,124, filed Mar. 20, 2007, the entire contents of each of which are incorporated herein by reference in their entireties.

BACKGROUND

This invention relates generally to microfabrication technology and, more specifically, to coaxial transmission line microstructures and to methods of forming such microstructures using a sequential build process. The invention has particular applicability to devices for transmitting electromagnetic energy and other electronic signals.

The formation of three-dimensional microstructures by sequential build processes has been described, for example, in U.S. Pat. No. 7,012,489, to Sherrer et al (the '489 patent). The '489 patent discloses a coaxial transmission line microstructure formed by a sequential build process. The microstructure is formed on a substrate and includes an outer conductor, a center conductor and one or more dielectric support members which support the center conductor. The volume between the inner and outer conductors is gaseous or vacuous, formed by removal of a sacrificial material from the structure which previously filled such volume.

For communication between the coaxial transmission line microstructures and the outside world, a connection between the coaxial transmission line and an external element is needed. The transmission line may, for example, be connected to a radio frequency (RF) or direct current (DC) cable, which in turn may be connected to another RF or DC cable, an RF module, an RF or DC source, a sub-system, a system and the like. In embodiments, the term "RF" should be understood to mean any frequency being propagated, specifically including microwave and millimeter wave frequencies.

Structures and methods for such external connection are not currently known in the art. In this regard, the process of connecting an external element to a coaxial transmission line microstructure is fraught with problems. Generally, the microstructures and standard connector terminations differ significantly in size. For example, the inner diameter of the outer conductor and outer diameter of the center conductor of a coaxial transmission line microstructure are typically on the order of 100 to 1000 microns and 25 to 400 microns, respectively. In contrast, the inner diameter of the outer conductor of a standard connector such as a 3.5 mm, 2.4 mm, 1 mm, GPPO (Corning Inc.), Subminature A (SMA), K (Anritsu Co.), or W (Anritsu Co.) connector is generally on the order of 1 mm or more, with the outer diameter of the inner conductor being determined by the impedance of the connector. Typically, microfabricated coaxial transmission lines have dimensions that may be from two to more than ten times smaller than the smallest of these standard connectors. Given the rather large difference in size between the microstructure and connector, a simple joining of the two structures is not possible. Such a junction typically produces attenuation, radiation, and reflection of the propagating waves to a degree that is not acceptable for most applications. A microfabricated transition structure allowing mechanical joining of the two structures while preserving the desired transmission properties, such as low insertion loss and low return reflections over the operating frequencies would thus be desired.

Adding to the difficulty of microstructure connectivity is the relatively delicate nature of the microstructures when considering the forces typically exerted on such connectors. The microstructures are formed from a number of relatively thin layers, with the center conductor being suspended in a gaseous or vacuous core volume within the outer conductor. Although periodic dielectric members are provided in the described microstructures to support the center conductor along its length, the microstructures are still susceptible to breakage and failure caused by excessive mechanical stresses. Such stresses would be expected to result from external forces applied to the microstructures during connection with large external components such as repeated mating with standard connectors.

Still further, when transitioning between the coaxial transmission line and another element through which an electric and/or electromagnetic signal is communicated, signal loss due to attenuation and return reflection can be problematic. In addition to loss of signal, return reflection can cause failure of circuits and/or failure of circuits to perform properly. Accordingly, a transition structure which allows for coupling of coaxial transmission line microstructures to external elements which preserves the desired transmission properties over the frequencies of operation without significant signal degradation due, for example, to attenuation and reflections is desired.

There is thus a need in the art for improved coaxial transmission line microstructures and for their methods of formation which would address one or more problems associated with the state of the art.

SUMMARY OF THE INVENTION

In accordance with a first aspect of the invention, provided are coaxial transmission line microstructures formed by a sequential build process. The microstructures include: a center conductor; an outer conductor disposed around the center conductor; a non-solid volume between the center conductor and the outer conductor; and a transition structure for transitioning between the coaxial transmission line and an electrical connector.

In accordance with further aspects of the invention, the transition structure may include an end portion of the center conductor, wherein the end portion has an increased dimension along an axis thereof, and an enlarged region of the outer conductor adapted to attach to the electrical connector, the end portion of the center conductor being disposed in the enlarged region of the outer conductor. The non-solid volume is typically vacuum, air or other gas. The coaxial transmission line microstructure is typically formed over a substrate which may form part of the microstructure. Optionally, the microstructure may be removed from a substrate on which it is formed. Such removed microstructure may be disposed on a different substrate. The coaxial transmission line microstructure may further include a support member in contact with the end portion of the center conductor for supporting the end portion. The support member may be formed of or include a dielectric material. The support member may be formed of a metal pedestal electrically isolating the center conductor and outer conductor by one or more intervening dielectric layers. The support member may take the form of a pedestal disposed beneath the end portion of the center conductor. At least a portion of the coaxial transmission line may have a rectangular coaxial (rectacoax) structure.

In accordance with further aspects of the invention, connectorized coaxial transmission line microstructures are provided. Such microstructures include a coaxial transmission line microstructure as described above, and an electric connector connected to the center conductor and the outer conductor. The connectorized microstructures may further include a rigid member to which the connector is attached.

In accordance with a further aspect of the invention, provided are methods of forming a coaxial transmission line microstructure. The methods include: disposing a plurality of layers over a substrate, wherein the layers comprise one or more of dielectric, conductive and sacrificial materials; and forming from the layers a center conductor, an outer conductor disposed around the center conductor, a non-solid volume between the center conductor and the outer conductor and a transition structure for transitioning between the coaxial transmission line and an electric connector.

Other features and advantages of the present invention will become apparent to one skilled in the art upon review of the following description, claims, and drawings appended hereto.

BRIEF DESCRIPTION OF THE DRAWINGS

The present invention will be discussed with reference to the following drawings, in which like reference numerals denote like features, and in which.

DETAIL DESCRIPTION OF THE INVENTION

Figure 1A:
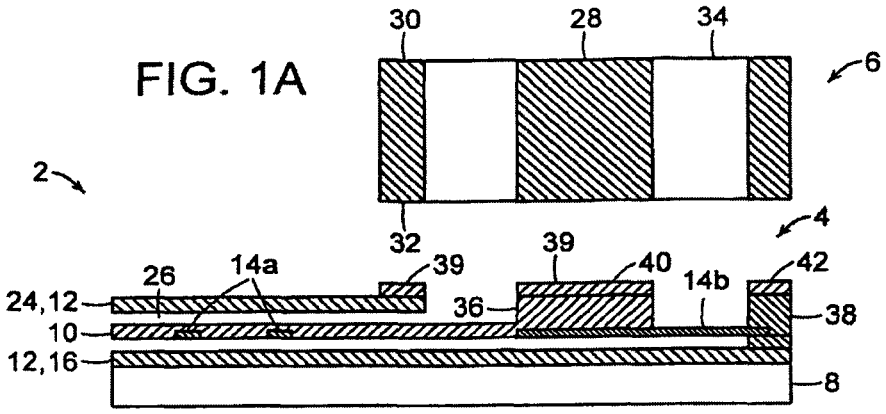
FIG. 1A-1C respectively illustrates side-sectional, top-sectional and perspective views of an exemplary coaxial transmission line microstructure in accordance with the invention.

The exemplary processes to be described involve a sequential build to create three-dimensional microstructures. The term "microstructure" refers to structures formed by microfabrication processes, typically on a wafer or grid-level. In the sequential build processes of the invention, a microstructure is formed by sequentially layering and processing various materials and in a predetermined manner. When implemented, for example, with film formation, lithographic patterning, deposition, etching and other optional processes such as planarization techniques, a flexible method to form a variety of three-dimensional microstructures is provided.

The sequential build process is generally accomplished through processes including various combinations of: (a) metal, sacrificial material (e.g., photoresist) and dielectric coating processes; (b) surface planarization; (c) photolithography; and (d) etching or planarization or other removal processes. In depositing metal, plating techniques are particularly useful, although other metal deposition techniques such as physical vapor deposition (PVD), screen printing and chemical vapor deposition (CVD) techniques may be used, the choice dependent on the dimensions of the coaxial structures, and the materials deployed.

The exemplary embodiments of the invention are described herein in the context of the manufacture of transition structures for allowing electric and/or electromagnetic connection between coaxial transmission line microstructures and external components. Such a structure finds application, for example, in the telecommunications and data communications industry, in chip to chip and interchip interconnect and passive components, in radar systems, and in microwave and millimeter-wave devices and subsystems. It should be clear, however, that the technology described for creating microstructures is in no way limited to the exemplary structures or applications but may be used in numerous fields for microdevices such as in pressure sensors, rollover sensors, mass spectrometers, filters, microfluidic devices, heat sinks, hermetic packages, surgical instruments, blood pressure sensors, air flow sensors, hearing aid sensors, micromechanical sensors, image stabilizers, altitude sensors and autofocus sensors. The invention can be used as a general method for fabricating transitions between microstructural elements for transmission of electric and/or electromagnetic signals and power with external components through a connector, for example, a microwave connector. The exemplified coaxial transmission line microstructures and related waveguides are useful for propagation of electromagnetic energy having a frequency, for example, of from several MHz to 200 GHz or more, including radio frequency waves, millimeter waves and microwaves. The described transmission lines find further use in providing a simultaneous DC or lower frequency voltage, for example, in providing a bias to integrated or attached semiconductor devices.

The invention will now be described with reference to FIG. 1A-1C, which illustrates side-sectional, top-sectional and perspective views, respectively, of an exemplary coaxial transmission line microstructure 2 with a transition structure 4 and electric and/or electromagnetic connector (hereafter, electrical connector or connector) 6, for example illustrated at least in FIG. 1A and FIG. 1C in accordance with one aspect of the invention. The exemplified microstructure 2 is formed by a sequential build process, and includes a substrate 8 (FIG. 1A), a center conductor 10, an outer conductor 12 disposed around and coaxial with the center conductor and one or more dielectric support members 14*a*, 14*b* for supporting the center conductor, for example illustrated in an aspect of embodiments at least in FIG. 1A. The outer conductor 12 includes a conductive base layer 16 forming a lower wall, plural conductive layers forming the sidewalls, and conductive layer 24 forming an upper wall of the outer conductor, for example illustrated in an aspect of embodiments at least in FIG. 1A and FIG. 1C. The conductive layers forming the lower wall 16 and upper wall 24 may optionally be provided as part of a conductive substrate or a conductive layer on a substrate. The volume 26, for example illustrated in an aspect of embodiments at least in FIG. 1A, between the center conductor and the outer conductor is a non-solid, for example, a gas such as air or sulfur hexafluoride, vacuous or a liquid. Optionally, the non-solid volume may be of a porous material such as a porous dielectric material formed, for example, from a dielectric material containing volatile porogens which may be removed with heating.

The transition structure 4 of the microstructure 2 provides a larger geometry and lends mechanical support to the microstructure allowing for coupling to an electrical connector 6 (FIGS. 1A & 1C) without damaging the microstructure. The transition additionally minimizes or eliminates unwanted signal reflection between the transmission line microstructure 2 and electrical connector 6.

Advantageously, standard off-the-shelf surface mountable connectors may be coupled to the microstructures of the invention. As shown for example in an aspect of embodiments at least in FIG. 1A and FIG. 1C, the connector 6 has a coaxial conductor structure including a center conductor 28 and an outer conductor 30. The illustrated connector has a uniform geometry throughout its height. The connector is to be joined to the microstructure 2 at a first end 32, for example illustrated in an aspect of embodiments at least in FIG. 1A, and to a mating connector connected to an external element (not shown), such as an RF or DC cable, which in turn may be connected to another such cable, an RF module, an RF or DC source, a sub-system, a system or the like, at a second end 34, for example illustrated in an aspect of embodiments at least in FIG. 1A. Suitable connectors include, for example, surface mount technology (SMT) versions of connectors such as 1 mm, 2.4 mm, 3.5 mm, Subminature A (SMA), K (Anritsu Co.), W (Anritsu Co.), Gilbert Push-On (GPO) and GPPO (Corning Inc.) connectors, and other standard connectors such as those designed to mate to coplanar waveguides.

The transition structure 4 can take various forms. Persons skilled in the art, given the exemplary structures and description herein, will understand that other designs may be employed. As shown, both the center conductor 10 and outer conductor 12 have an increased dimension at respective end portions 36, 38 so as to be complementary in geometry to the center conductor 28 and outer conductor 30 of the electrical connector with which connection is to be made. For the center conductor, this increase in dimension is typically in the form of an increase in width, achieved by tapering the end portion of the center conductor from that of the transmission line standard width to that of the connector center conductor 28. In this case, the exemplified center conductor end portion 36 also has an increase in the height dimension such that its height is the same as the outer conductor in the transition structure for purposes of bonding to the connector. One or more solder layers 39, for example illustrated in an aspect of embodiments at least in FIG. 1A and FIG. 1B, or other conductive bonding agent may be disposed on the center and outer conductor in the transition structure to allow bonding with the connector. In the illustrated microstructure, for example illustrated in an aspect of embodiments at least in FIG. 1A, the height of the center conductor mating surface 40 is equal to that of the mating surface 42 of the outer conductor in the transition region. To allow mating between the connector and microstructure transition structure, the upper wall 24 of the outer conductor transition structure is open, thereby exposing the center conductor end portion 36.

As with other regions of the transmission line microstructure, the center conductor is suspended in the transition structure with a support structure. However, as a result of the geometrical change of the center conductor and increased mass in the transition structure 4, the load of the transmission line in the transition structure can be significantly greater than that in other regions of the transmission line. As such, the design of a suitable support structure for the center conductor end portion 36 will generally differ from that of the dielectric support members 14*a* used in the main regions of the transmission line. The design of the support structure for the end portion 36 may take various forms and will depend on the mechanical loads and stresses as a result of its mass and environment, as well as the added mechanical forces it may be subject to as a result of the attachment and use of the connector structure, particularly those associated with the center conductor 28. In this exemplified structure for the end portion, the support structure for the end portion takes the form of plural dielectric support members 14*b*, which may be in the form of straps as illustrated in FIGS. 1B & 1C. The dielectric support members 14*b* as illustrated extend across the diameter of the outer conductor in the transition structure and are arranged in a spoke pattern. The dielectric support members 14*b* are embedded in the outer conductor 38. While the dielectric support members as illustrated extend below the center conductor end portion 36, it should be clear that they may be embedded in the end portion 36.

Figure 1B:
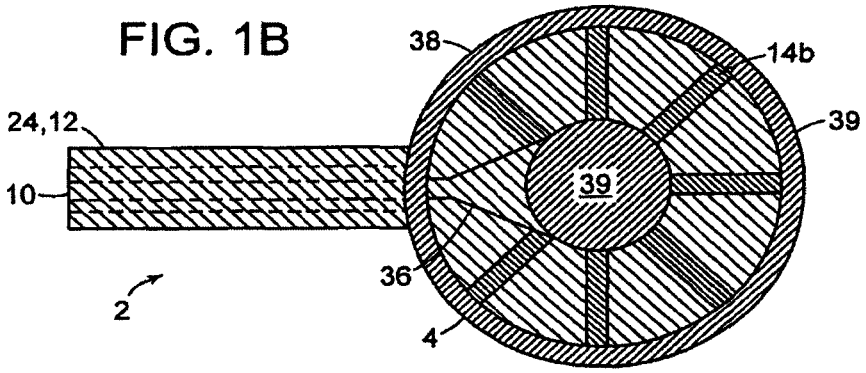
Figure 1C:
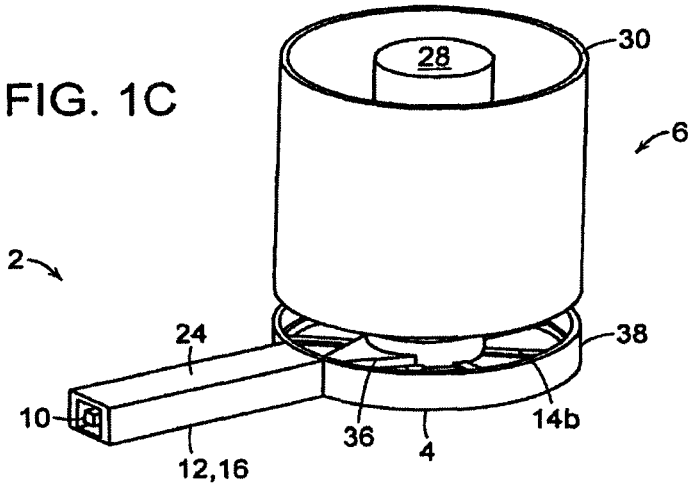
Figure 2A:
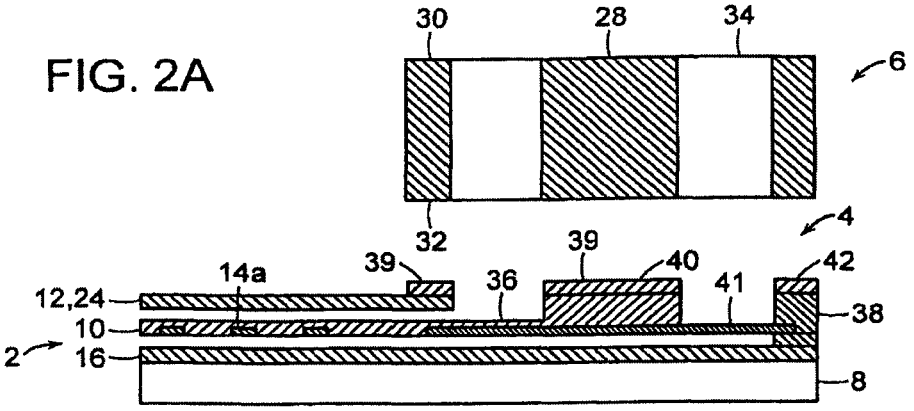
FIG. 2A-2C respectively illustrates side-sectional, top-sectional and perspective views of an exemplary coaxial transmission line microstructure in accordance with a further aspect of the invention.
Figure 2B:
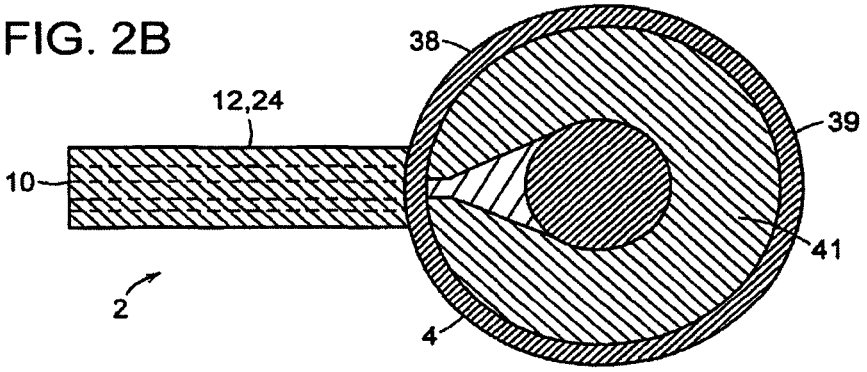
Figure 2C:
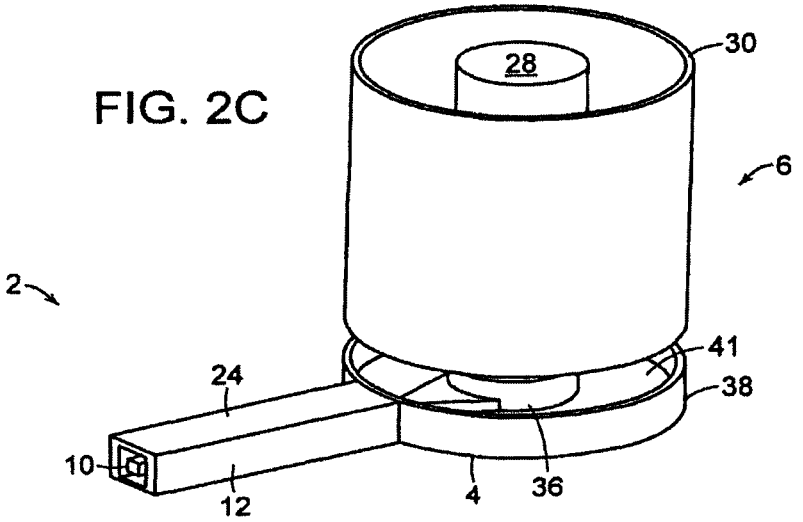

A further design for a suitable support structure for the center conductor end portion 36 is illustrated in FIG. 2A-2C, which respectively shows side-sectional, top-sectional and perspective views of a further exemplary coaxial transmission line microstructure. Except as otherwise described, the description with respect to the exemplary structures of FIG. 1A-1C is generally applicable to the structures shown in FIG. 2A and FIG. 2C, as well as the additional exemplary structures to be described. In the microstructure illustrated for example in an aspect of embodiments at least in FIG. 2A and FIG. 2C, the support structure takes the form of a dielectric sheet 41 which supports the end portion 36 from below. As shown, the dielectric sheet 41 can be disposed across the entire transition structure or, alternatively, over a portion thereof.

Figure 3A:
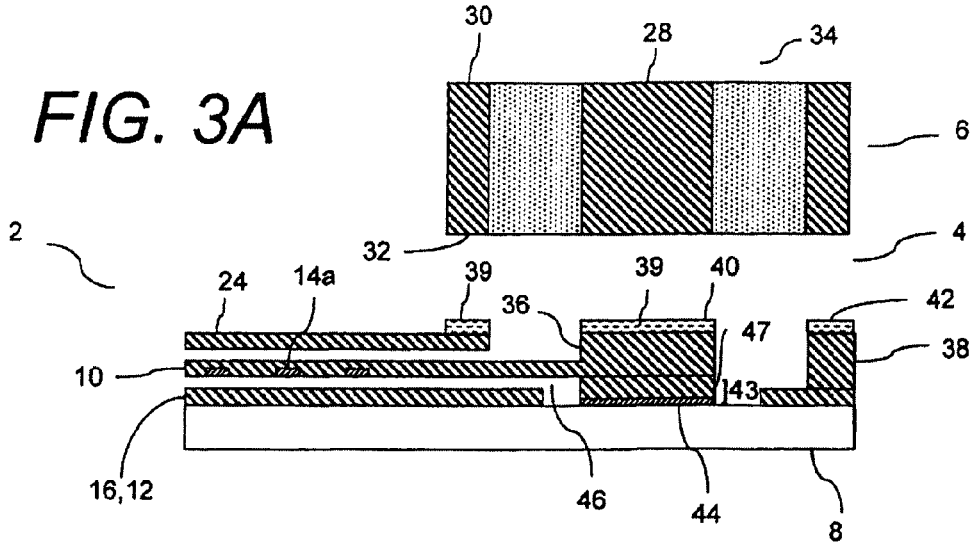
FIG. 3A-3B respectively illustrates side- and top-sectional views of an exemplary coaxial transmission line microstructure in accordance with a further aspect of the invention.
Figure 3B:
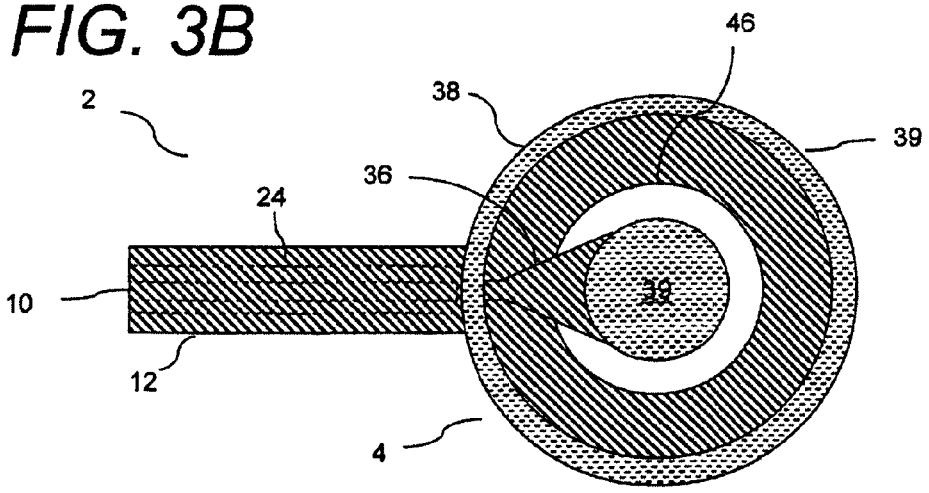

As an alternative to or in addition to a sidewall-anchored support structure such those described above for the transition center conductor end portion, a structure for supporting the end portion from below may be employed. FIGS. 3A-3B respectively illustrates side- and top-sectional views of such an exemplary support structure which includes a support pedestal 43 disposed below and in supporting contact with the center conductor end portion. The pedestal is formed at least in part from a dielectric material layer 44 so as to electrically isolate the center conductor from the outer conductor and substrate. An advantage of this pedestal-type support structure over the previously described embodiments is its ability to withstand greater forces during connection with the connector and in normal use. The support structure includes a dielectric material 44, for example illustrated in an aspect of embodiments at least in FIG. 3A, formed on the substrate or optionally on the lower wall of the transition outer conductor for electrical isolation of the center conductor 10 from the substrate 8. The exemplified structure includes a dielectric layer 44 such as a silicon nitride or silicon oxide layer on the surface of substrate 8, for example illustrated in an aspect of embodiments at least in FIG. 3A. An opening 46 in the base layer 16 of the outer conductor may be provided in the transition structure to reduce capacitive coupling of the center and outer conductors. The pedestal 43 is built up to a height such that the center conductor end portion 36 is directly supported thereby. The pedestal may include one or more additional layers of the same or a different material, including dielectric and/or conductive materials. In the exemplified structure, a conductive layer 47, for example illustrated in an aspect of embodiments at least in FIG. 3A, of the same material as the outer conductor is provided over the dielectric layer 44.

Figure 4A:
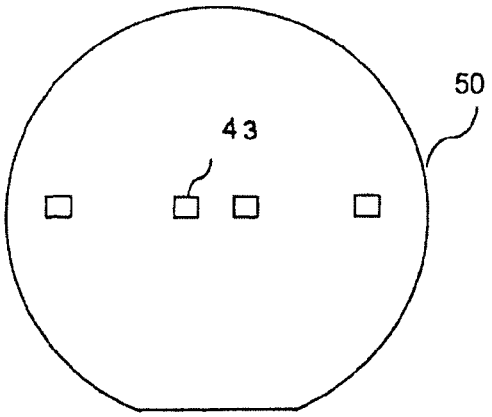
FIG. 4A-4C illustrates the joining to a substrate of an exemplary released coaxial transmission line microstructure in accordance with a further aspect of the invention.
Figure 4B:
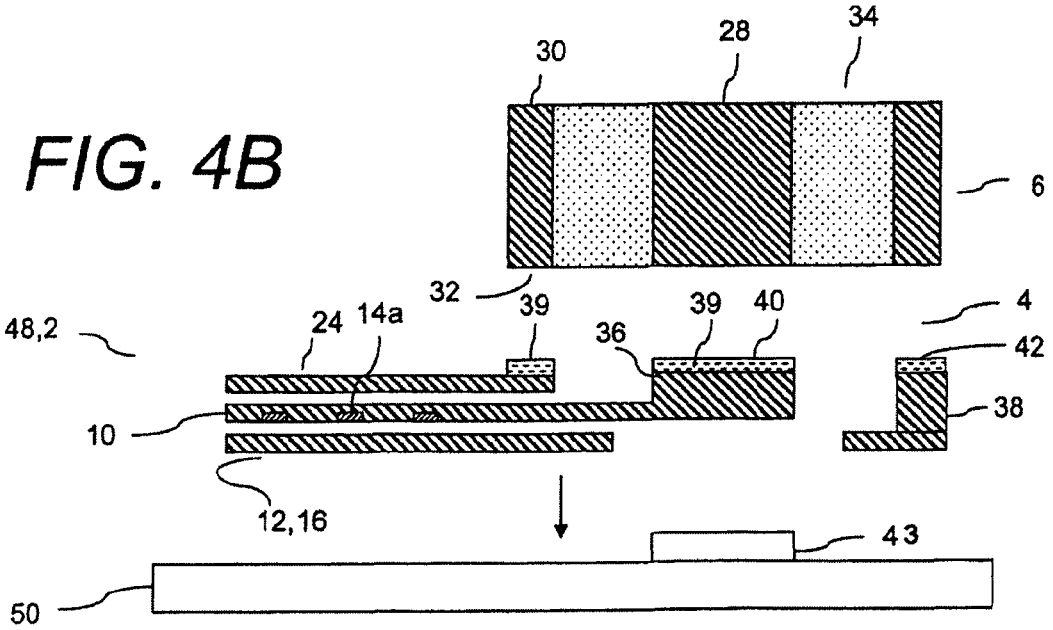
Figure 4C:
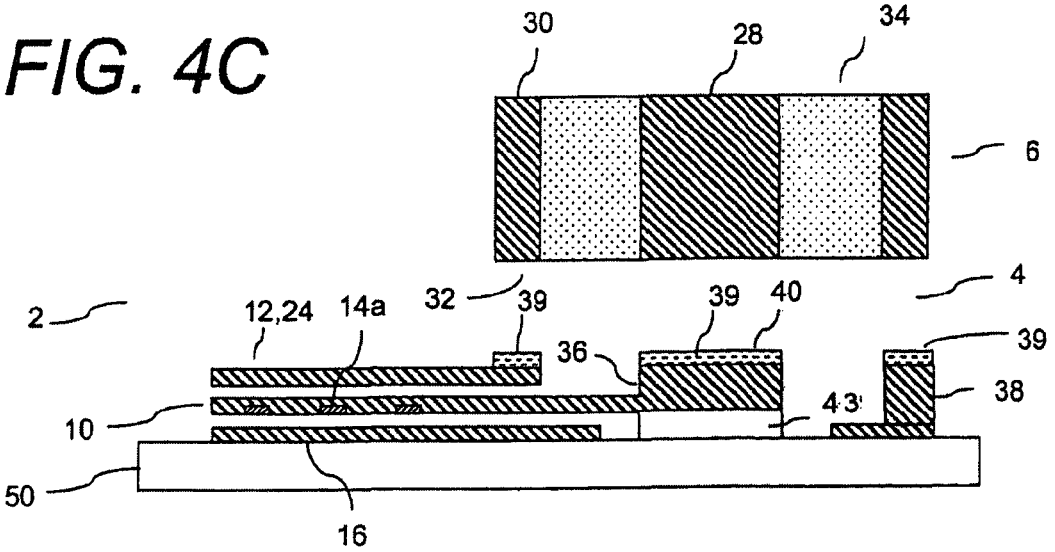

In accordance with a further aspect of the invention and as described in greater detail below, the coaxial transmission line microstructure may be released from the substrate on which it is formed. As illustrated in FIG. 4A-4B, the released microstructure 48, for example illustrated in an aspect of embodiments at least in FIG. 4B, may be joined to a separate substrate 50 on which is provided one or more support pedestals 43 for supporting the center conductor end portion 36, for example illustrated in an aspect of embodiments at least in FIG. 4B, of the released microstructure. The connector 6, for example illustrated in an aspect of embodiments at least in FIG. 4B, may then be connected to the pedestal-supported microstructure. The support pedestals 43 may take the form, for example, of a printed circuit board, a ceramic, or a semiconductor, such as silicon, the post being formed on or as a part of the surface of the substrate 50 which itself may be of the same material. In this case, the pedestal 43 may be formed by machining or etching the substrate 50 surface. In another exemplary aspect, the support pedestal may be formed from a dielectric material, for example, a photoimageable dielectric material such as photosensitive-benzocyclobutene (Photo-BCB) resins such as those sold under the tradename Cyclotene (Dow Chemical Co.) and SU-8 resist (MicroChem. Corp.). Alternatively, the support pedestals 43 may be formed and adhered to the released structure 48 rather than formed on the substrate 50.

Figure 5A:
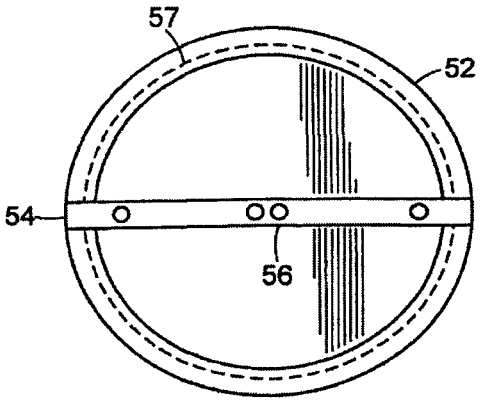
FIG. 5A-5C illustrates a frame for supporting a connectorized coaxial transmission line microstructure in accordance with a further aspect of the invention.
Figure 5B:
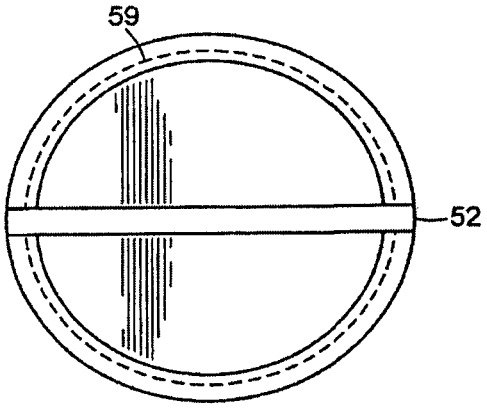
Figure 5C:
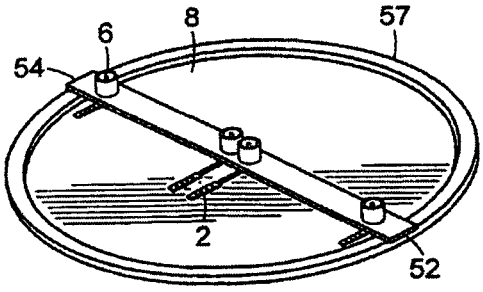

While being larger in geometry than the transmission line microstructures, the electrical connectors 6 are still of a sufficiently small size making them difficult to handle manually. For ease of handling and to reduce the mechanical stress and strain of connection to the microstructures, particularly in the case of released microstructures, a connector frame may be provided as shown in FIGS. 5A-5C. The exemplary connector frame 52 includes a rigid, durable member 54, for example illustrated in an aspect of embodiments at least in FIG. 5A and FIG. 5C, constructed of, for example, a metal or metal alloy such as aluminum, stainless steel or a zinc alloy, or a dielectric material such as a ceramic material, for example, aluminum nitride or alumina, or a plastic. Use of a metal or metal alloy may be desired for purposes of providing a grounding structure as well as its ability to function as a heat sink. In this regard, the microstructures can be capable of very high power outputs, for example, in excess of 100 Watts, causing significant heat production which can adversely affect the conductive materials making up the microstructures. The member 54 has one or more apertures 56, for example illustrated in an aspect of embodiments at least in FIG. 5A, extending therethrough having a geometry complementary to the connectors 6, for example illustrated in an aspect of embodiments at least in FIG. 5C, such that the outside diameter of the connectors fit within the apertures. The connectors may be fixed in place by pressure fit and/or preferably by use of an appropriate adhesive or solder around the external surface of the connector. The frame 52 provides a rigid structure to facilitate handling and connection and mating of cables or other hardware to the connectors attached in the frame that are mated to the microstructures 2 as shown in FIG. 5C. Thus, connection can easily be conducted by handling the frame instead of the individual connectors.

The frame may further include a ring-, rectangular- or other-shaped structure 57, for example illustrated in an aspect of embodiments at least in FIG. 5A and FIG. 5C, complementary in shape to the substrate 8, for example illustrated in an aspect of embodiments at least in FIG. 5C, if any, on which the microstructures are disposed. The ring-shaped structure may include a recess as shown by the dashed line for receiving the microstructure support or substrate. The components may, for example, include a metal structural support in which they are embedded, for example, a released metal layer from the original substrate which may also form the bottom wall of the outer conductor or a metal open honeycomb structure. Such structures can be formed at the same time and using the same process as used to make the micro-coaxial and/or waveguiding structures shown in the build sequence discussed with reference to FIGS. 6A-6M, where such an open structure is used to fill empty regions between the various coaxial members. The frame may optionally include a similar ring-shaped structure 59, for example illustrated in an aspect of embodiments at least in FIG. 5B, with or without connectors, over the reverse surface of the microstructure substrate in a clamshell configuration. Such a structure would be useful to provide support for the center conductor as shown in FIGS. 3A-3B and FIGS. 4A-4C for those cases where the coaxial microstructures are released from their substrate. Release from the substrate is particularly useful where devices such as antennae and connectors are disposed and/or formed on opposite sides of the coaxial microstructures.

Figure 6A:
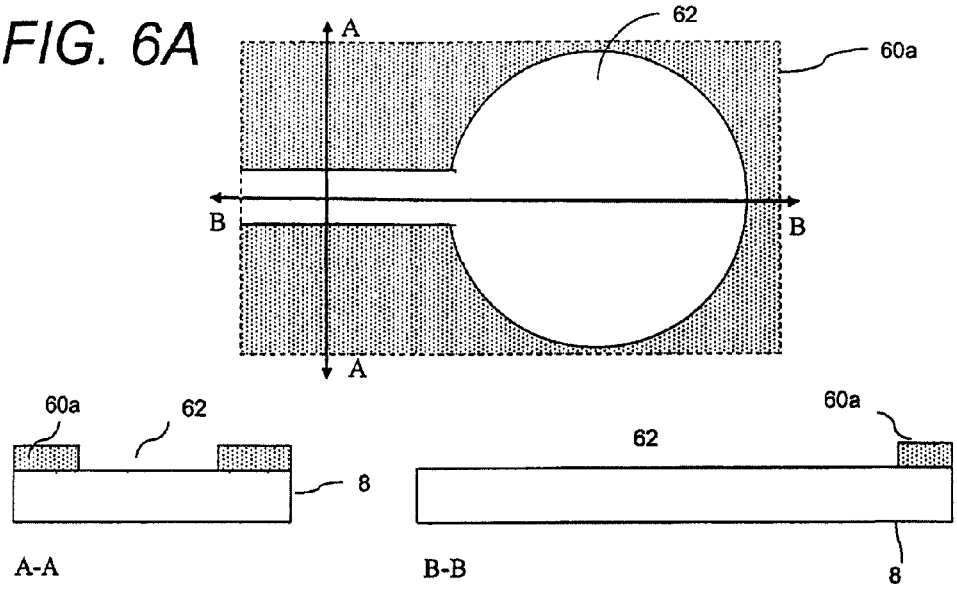
FIG. 6A-6M respectively illustrates side- and top-sectional views of an exemplary three-dimensional microstructure with transition structure at various stages of formation in accordance with the invention.

Exemplary methods of forming the coaxial transmission line microstructure of FIG. 1 will now be described with reference to FIG. 6A-6M. The transmission line is formed on a substrate 8 as shown in FIG. 6A, which may take various forms. The substrate may, for example, be constructed of a ceramic, a dielectric such as aluminum nitride, a semiconductor such as silicon, silicon-germanium or gallium arsenide, a metal such as copper or stainless steel, a polymer or a combination thereof. The substrate can take the form, for example, of an electronic substrate such as a printed wiring board or a semiconductor substrate, such as a silicon, silicon germanium, or gallium arsenide wafer. Such substrate wafers may contain active devices and/or other electronics elements. The substrate may be selected to have an expansion coefficient similar to the materials used in forming the transmission line, and should be selected so as to maintain its integrity during formation of the transmission line. The surface of the substrate on which the transmission line is to be formed is typically substantially planar. The substrate surface may, for example, be ground, lapped and/or polished to achieve a high degree of planarity. If the substrate is not a suitable conductor, a conductive sacrificial layer may be deposited on the substrate. This can, for example, be a vapor deposited seed layer such as chrome and gold. Any of the methods of depositing conductive base layers for subsequent electroplating can be used. A first layer 60*a* of a sacrificial photosensitive material, for example, a photoresist, may next be deposited over the substrate 8, and is exposed and developed to form a pattern 62 for subsequent deposition of the bottom wall of the transmission line outer conductor in both the transmission line main region and transition structure. The pattern 62 includes a channel in the sacrificial material, exposing the top surface of the substrate 8. Conventional photolithography steps and materials can be used for this purpose.

The sacrificial photosensitive material can be, for example, a negative photoresist such as Shipley BPR™ 100 or PHOTOPOSIT™ SN, and LAMINAR™ dry films, commercially available from Rohm and Haas Electronic Materials LLC. Particularly suitable photosensitive materials are described in U.S. Pat. No. 6,054,252. Suitable binders for the sacrificial photosensitive material include, for example: binder polymers prepared by free radical polymerization of acrylic acid and/or methacrylic acid with one or more monomers chosen from acrylate monomers, methacrylate monomers and vinyl aromatic monomers (acrylate polymers); acrylate polymers esterified with alcohols bearing (meth)acrylic groups, such as 2-hydroxyethyl(meth)acrylate, SB495B (Sartomer), Tone M-100 (Dow Chemical) or Tone M-210 (Dow Chemical); copolymers of styrene and maleic anhydride which have been converted to the half ester by reaction with an alcohol; copolymers of styrene and maleic anhydride which have been converted to the half ester by reaction with alcohols bearing (meth)acrylic groups, such as 2-hydroxyethyl methacrylate, SB495B (Sartomer), Tone M-100 (Dow Chemical) or Tone M-210 (Dow Chemical); and combinations thereof. Particularly suitable binder polymers include: copolymers of butyl acrylate, methyl methacrylate and methacrylic acid and copolymers of ethyl acrylate, methyl methacrylate and methacrylic acid; copolymers of butyl acrylate, methyl methacrylate and methacrylic acid and copolymers of ethyl acrylate, methyl methacrylate and methacrylic acid esterified with alcohols bearing methacrylic groups, such as 2-hydroxyethyl(meth) acrylate, SB495B (Sartomer), Tone M-100 (Dow Chemical) or Tone M-210 (Dow Chemical); copolymers of styrene and maleic anhydride such as SMA 1000F or SMA 3000F (Sartomer) that have been converted to the half ester by reaction with alcohols such as 2-hydroxyethyl methacrylate, SB495B (Sartomer), Tone M-100 (Dow Chemical) or Tone M-210 (Dow Chemical), such as Sarbox SB405 (Sartomer); and combinations thereof.

Suitable photoinitiator systems for the sacrificial photosensitive compositions include Irgacure 184, Duracur 1173, Irgacure 651, Irgacure 907, Duracur ITX (all of Ciba Specialty Chemicals) and combinations thereof. The photosensitive compositions may include additional components, such as dyes, for example, methylene blue, leuco crystal violet, or Oil Blue N; additives to improve adhesion such as benzotriazole, benzimidazole, or benzoxizole; and surfactants such as Fluorad® FC-4430 (3M), Silwet L-7604 (GE), and Zonyl FSG (DuPont).

The thickness of the sacrificial photosensitive material layers in this and other steps will depend on the dimensions of the structures being fabricated, but are typically from 1 to 250 microns per layer, and in the case of the embodiments shown are more typically from 20 to 100 microns per strata or layer.

The developer material will depend on the material of the photoresist. Typical developers include, for example, TMAH developers such as the Microposit™ family of developers (Rohm and Haas Electronic Materials) such as Microposit MF-312, MF-26A, MF-321, MF-326W and MF-CD26 developers.

Figure 6B:
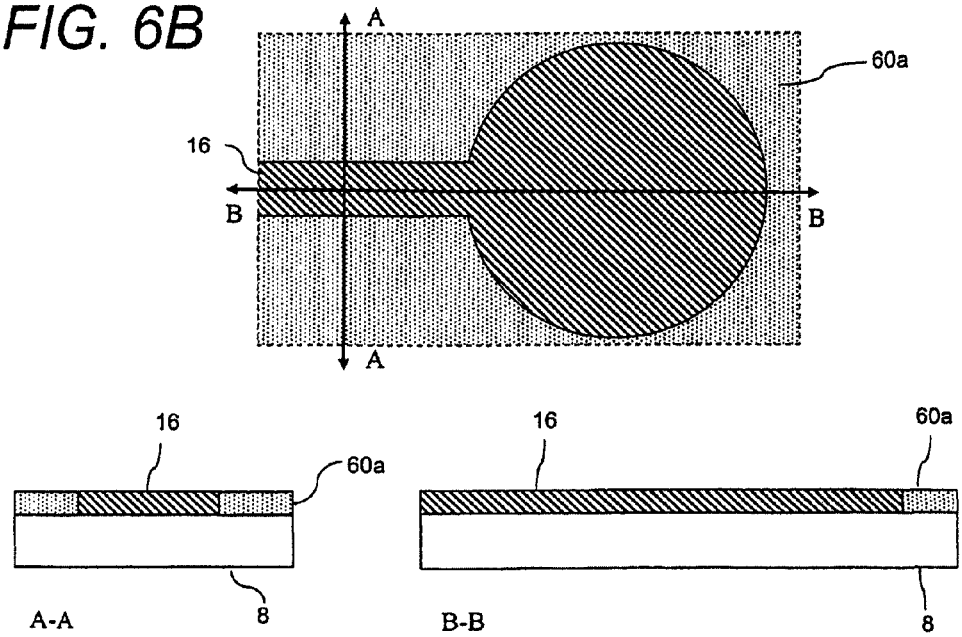

As shown in FIG. 6B, a conductive base layer 16 is formed over the substrate 8 and forms a lower wall of the outer conductor in the final structure for both the transmission line main region and transition structure. The base layer 16 is typically formed of a material having high conductivity, such as a metal or metal-alloy (collectively referred to as "metal"), for example copper, silver, nickel, iron, aluminum, chromium, gold, titanium, alloys thereof, a doped semiconductor material, or combinations thereof, for example, multiple layers and/or multiple coatings of such materials in various combinations. The base layer may be deposited by a conventional process, for example, by plating such as electrolytic or electroless, or immersion plating, physical vapor deposition (PVD) such as sputtering or evaporation, or chemical vapor deposition (CVD). Plated copper may, for example, be particularly suitable as the base layer material, with such techniques being well understood in the art. The plating can be, for example, an electroless process using a copper salt and a reducing agent. Suitable materials are commercially available and include, for example, CIRCUPOSIT™ electroless copper, available from Rohm and Haas Electronic Materials LLC, Marlborough, Mass. Alternatively, the material can be plated by coating an electrically conductive seed layer on top of or below the photoresist. The seed layer may be deposited by PVD over the substrate prior to coating of the sacrificial material, for example a first layer 60*a* of a sacrificial photosensitive material. The use of an activated catalyst followed by electroless and/or electrolytic deposition may be used. The base layer (and subsequent layers) may be patterned into arbitrary geometries to realize a desired device structure through the methods outlined.

The thickness of the base layer 16 (and the subsequently formed other walls of the outer conductor) is selected to provide mechanical stability to the microstructure and to provide sufficient conductivity of the transmission line to provide sufficiently low loss. At microwave frequencies and beyond, structural influences become more pronounced, as the skin depth will typically be less than 1 μm. The thickness thus will depend, for example, on the specific base layer material, the particular frequency to be propagated and the intended application. In instances in which the final structure is to be removed from the substrate, it may be beneficial to employ a relatively thick base layer, for example, from about 20 to 150 μm or from 20 to 80 μm, for structural integrity. Where the final structure is to remain intact with the substrate, it may be desired to employ a relatively thin base layer which may be determined by the skin depth requirements of the frequencies used. In addition, a material with suitable mechanical properties may be chosen for the structure, and then it can be overcoated with a highly conductive material for its electrical properties. For example, nickel base structures can be overcoated with gold or silver using an electrolytic or more typically an electroless plating process. Alternatively, the base structure may be overcoated with materials for other desired surface properties. For example, copper may be overcoated with electroless nickel and gold, or electroless silver, to help prevent oxidation. Other methods and materials for overcoating may be employed as are known in the art to obtain, for example, one or more of the target mechanical, chemical, electrical and corrosion-protective properties.

Appropriate materials and techniques for forming the sidewalls are the same as those mentioned above with respect to the base layer. The sidewalls are typically formed of the same material used in forming the base layer 16, although different materials may be employed. In the case of a plating process, the application of a seed layer or plating base may be omitted as here when metal in a subsequent step will only be applied directly over a previously formed, exposed metal region. It should be clear, however, that the exemplified structures shown in the figures typically make up only a small area of a particular device, and metallization of these and other structures may be started on any layer in the process sequence, in which case seed layers are typically used.

Surface planarization at this stage and/or in subsequent stages can be performed in order to remove any unwanted metal deposited on the top surface or above the sacrificial material, providing a flat surface for subsequent processing. Conventional planarization techniques, for example, chemical-mechanical-polishing (CMP), lapping, or a combination of these methods are typically used. Other known planarization or mechanical forming techniques, for example, mechanical finishing such as mechanical machining, diamond turning, plasma etching, laser ablation, and the like, may additionally or alternatively be used. Through surface planarization, the total thickness of a given layer can be controlled more tightly than might otherwise be achieved through coating alone. For example, a CMP process can be used to planarize the metal and the sacrificial material to the same level. This may be followed, for example, by a lapping process, which slowly removes metal, sacrificial material, and any dielectric at the same rate, allowing for greater control of the final thickness of the layer.

Figure 6C:
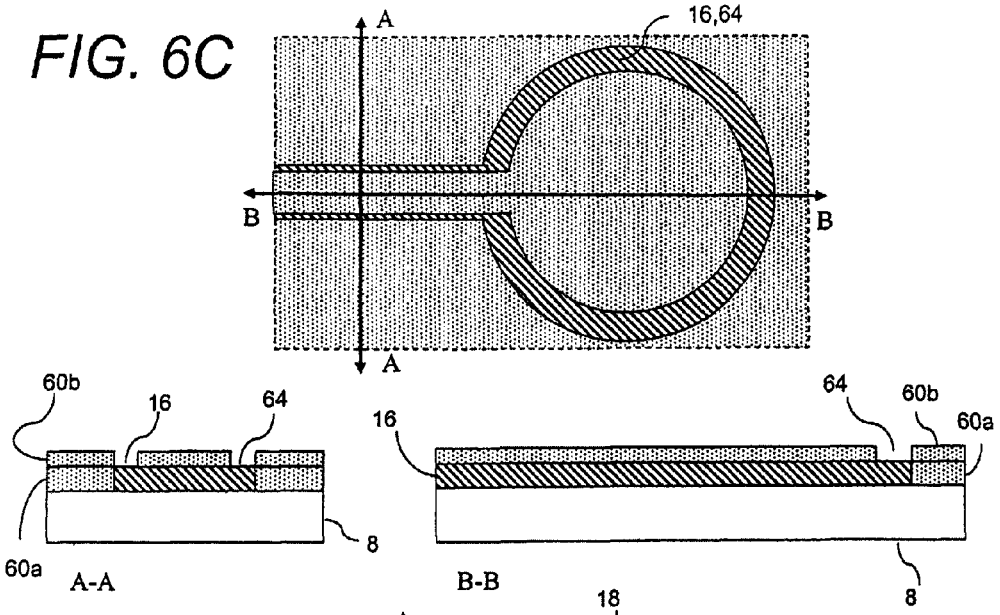

With reference to FIG. 6C, a second layer 60*b* of the sacrificial photosensitive material is deposited over the base layer 16 and first sacrificial layer 60*a*, and is exposed and developed to form a pattern 64 for subsequent deposition of lower sidewall portions of the transmission line outer conductor in the transmission line main region and transition structure. The pattern 64 includes a channel exposing the top surface of the base layer 16 where the outer conductor sidewalls are to be formed.

Figure 6D:
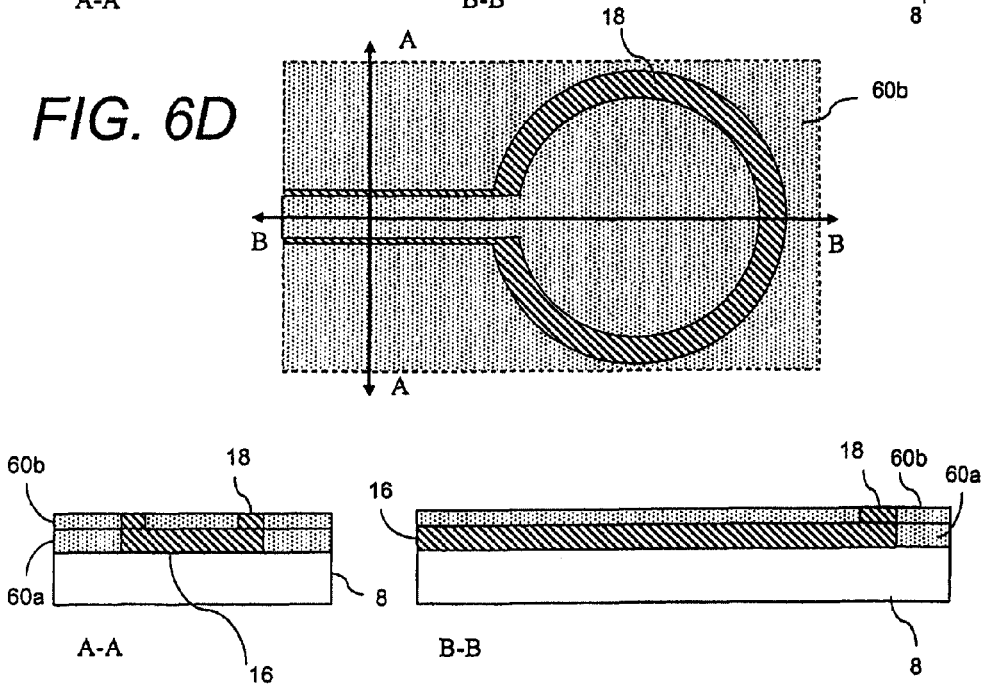

As shown in FIG. 6D, lower sidewall portions 18 of the transmission line outer conductor for the transmission line main region and transition structure are next formed. Appropriate materials and techniques for forming the sidewalls are the same as those mentioned above with respect to the base layer 16 although different materials may be employed. In the case of a plating process, the application of a seed layer or plating base may be omitted as here when metal in a subsequent step will only be applied directly over a previously formed, exposed metal region. Surface planarization as described above may be conducted at this stage.

Figure 6E:
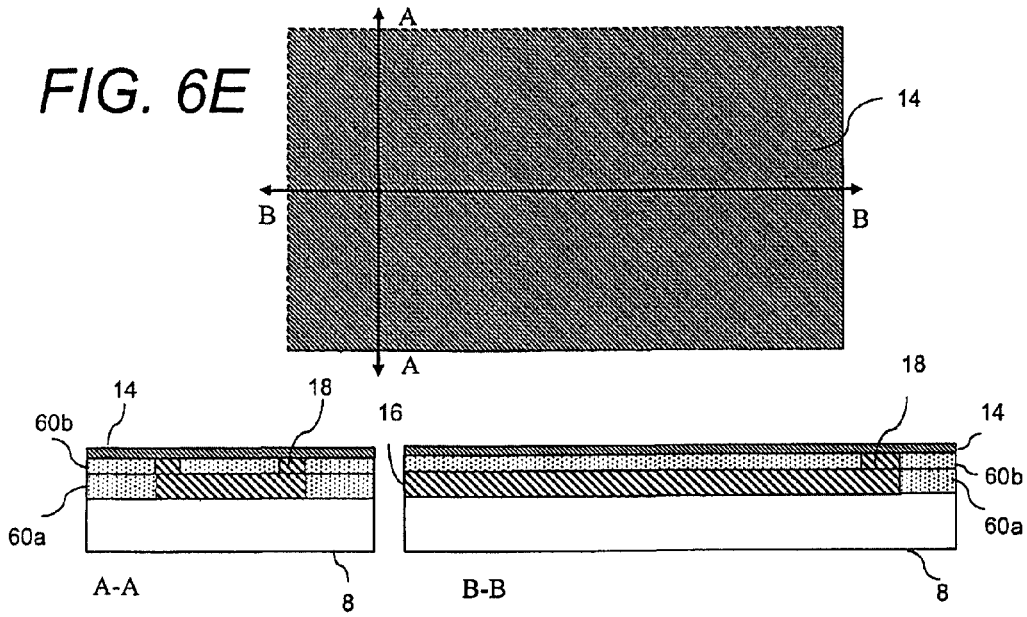

A layer 14 of a dielectric material is next deposited over the second sacrificial layer 60*b* and the lower sidewall portions 18, as shown in FIG. 6E. In subsequent processing, support structures are patterned from the dielectric layer to support the transmission line's center conductor to be formed in both the main region and the transition structure. As these support structures will lie in the core region of the final transmission line structure, the dielectric support layer 14 should be formed from a material which will not create excessive losses for the signals to be transmitted through the transmission line. The material should also be capable of providing the mechanical strength necessary to support the center conductor along its length, including the end region in the transition structure. The material should further be relatively insoluble in the solvent used to remove the sacrificial material from the final transmission line structure. The material is typically a dielectric material selected from photosensitive-benzocyclobutene (Photo-BCB) resins such as those sold under the tradename Cyclotene (Dow Chemical Co.), SU-8 resist (MicroChem. Corp.), inorganic materials, such as silicas and silicon oxides, SOL gels, various glasses, silicon nitride ($Si_3N_4$), aluminum oxides such as alumina ($Al_2O_3$), aluminum nitride (AlN), and magnesium oxide (MgO); organic materials such as polyethylene, polyester, polycarbonate, cellulose acetate, polypropylene, polyvinyl chloride, polyvinylidene chloride, polystyrene, polyamide, and polyimide; organic-inorganic hybrid materials such as organic silsesquioxane materials; a photodefinable dielectric such as a negative acting photoresist or photoepoxy which is not attacked by the sacrificial material removal process to be conducted. In addition, combinations of these materials including composites and nano-composites of inorganic materials such as silica powders that are loaded into polymer materials may be used, for example to improve mechanical or chemical properties. Of these, SU-8 2015 resist is typical. It is advantageous to use materials which can be easily deposited, for example, by spin-coating, roller coating, squeegee coating, spray coating, chemical vapor deposition (CVD) or lamination. The dielectric material layer 14 is deposited to a thickness that provides for the requisite support of the center conductor without cracking or breakage. In addition, the thickness should not severely impact subsequent application of sacrificial material layers from the standpoint of planarity. While the thickness of the dielectric support layer will depend on the dimensions and materials of the other elements of the microstructure, the thickness is typically from 1 to 100 microns, for example, about 20 microns.

Figure 6F:
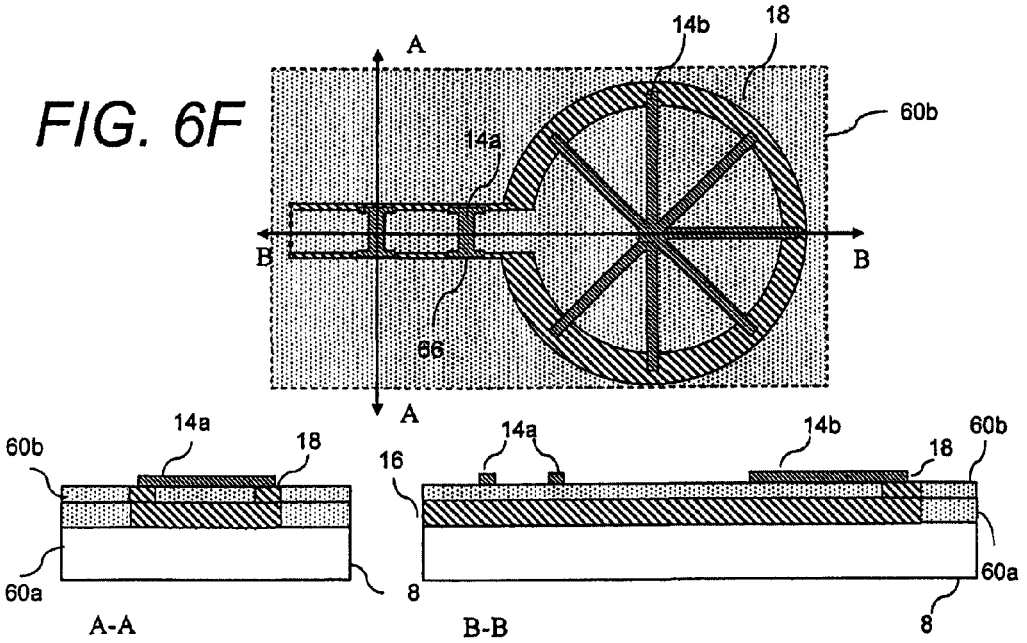

Referring to FIG. 6F, the dielectric material layer 14 (FIG. 6E) is next patterned using standard photolithography and developing techniques in the case of a photoimageable material to provide one or more first dielectric support members 14*a* for supporting the center conductor in the main region of the transmission line and second dielectric support members 14*b* in the transition structure. In the illustrated device, the dielectric support members 14*a* extend from a first side of the outer conductor to an opposite side of the outer conductor. In another exemplary aspect, the dielectric support members may extend from the outer conductor and terminate at the center conductor. In this case, one end of each of the support members 14*a* is formed over one or the other lower sidewall portion 18 and the opposite end extends to a position over the sacrificial layer 60*b* between the lower sidewall portions. The support members 14*a* are spaced apart from one another, typically at a fixed distance. The number, shape, and pattern of arrangement of the dielectric support members 14*a* should be sufficient to provide support to the center conductor while also preventing excessive signal loss and dispersion.

The dielectric support members 14*a* and 14*b* may be patterned with geometries allowing for the elements of the microstructure to be maintained in mechanically locked engagement with each other, reducing the possibility of their pulling away from the outer conductor. In the exemplified microstructure, the dielectric support members 14*a* are patterned in the form of a "T" shape at each end (or an "I" shape) during the patterning process. Although not shown, such a structure may optionally be used for the transition dielectric support members 14*b*. During subsequent processing, the top portions 66 of the T structures become embedded in the wall of the outer conductor and function to anchor the support members therein, rendering them more resistant to separation from the outer conductor. While the illustrated structure includes an anchor-type locking structure at each end of the dielectric support members 14*a*, it should be clear that such a structure may be used at a single end thereof. Further, the dielectric support members may optionally include an anchor portion on a single end in an alternating pattern. Reentrant profiles and other geometries providing an increase in cross-sectional geometry in the depthwise direction are typical. In addition, open structures, such as vias, in the central region of the dielectric pattern may be used to allow mechanical interlocking with subsequent metal regions to be formed.

Figure 6G:
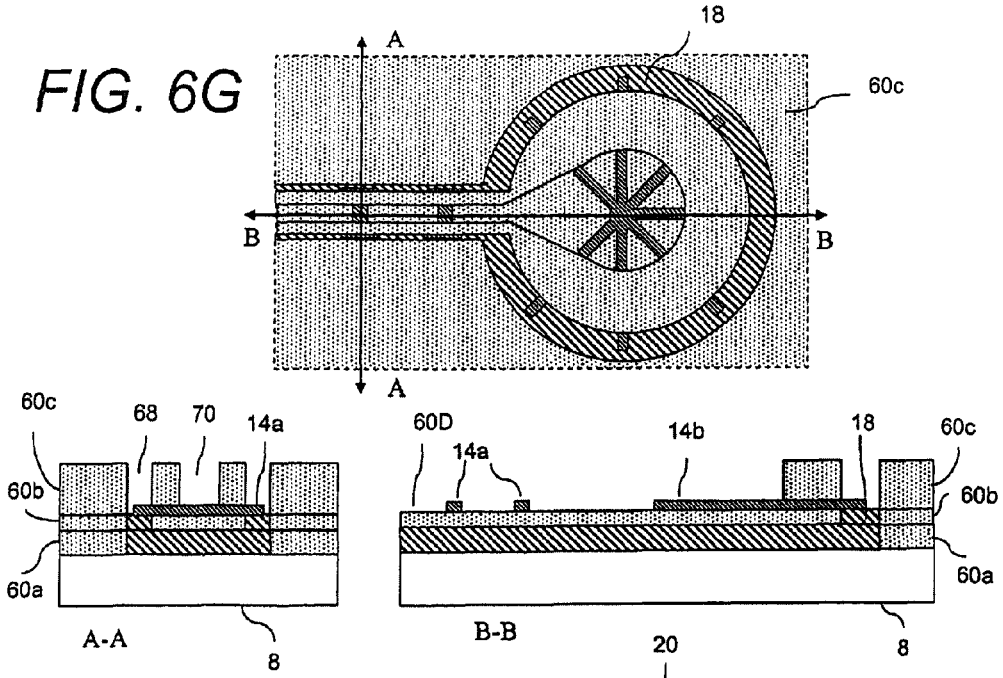

With reference to FIG. 6G, a third sacrificial photosensitive layer 60*c* is coated over the substrate, and is exposed and developed to form patterns 68, 70 for formation of middle sidewall portions of the transmission line outer conductor and the center conductor in the transition line main region and transition structure. The pattern 68 for the middle sidewall portion is coextensive with the lower sidewall portions 18. The lower sidewall portions 18 and the end of the dielectric support members 14*a*, 14*b* overlying the lower sidewall portions are exposed by pattern 68. The pattern 70 for the center conductor is a channel along the length of the microstructure which tapers out at the transition structure. The pattern 70 exposes supporting portions of the center conductor support members 14*a* and 14*b*. Conventional photolithography techniques and materials, such as those described above, can be used for this purpose.

Figure 6H:
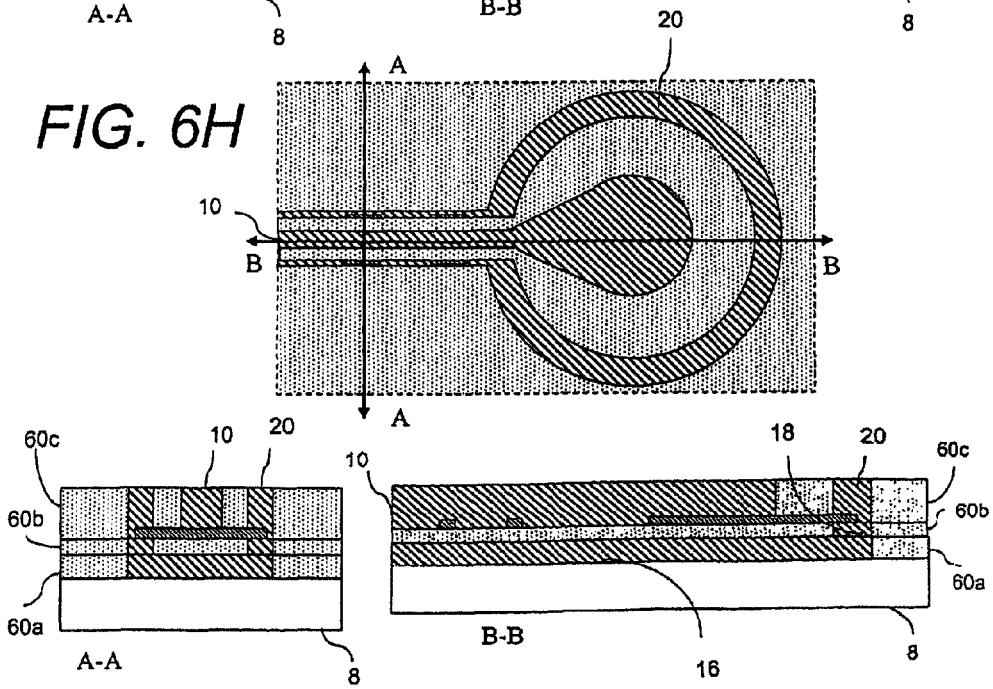

As illustrated in FIG. 6H, the center conductor 10 and middle sidewall portions 20 of the outer conductor are formed by depositing a suitable metal material into the channels formed in the third sacrificial material layer 60*c*. Appropriate materials and techniques for forming the middle sidewall portions and center conductor are the same as those mentioned above with respect to the base layer 16 and lower sidewall portions 18, although different materials and/or techniques may be employed. Surface planarization may optionally be performed at this stage to remove any unwanted metal deposited on the top surface of the sacrificial material in addition to providing a flat surface for subsequent processing, as has been previously described and optionally applied at any stage.

Figure 6I:
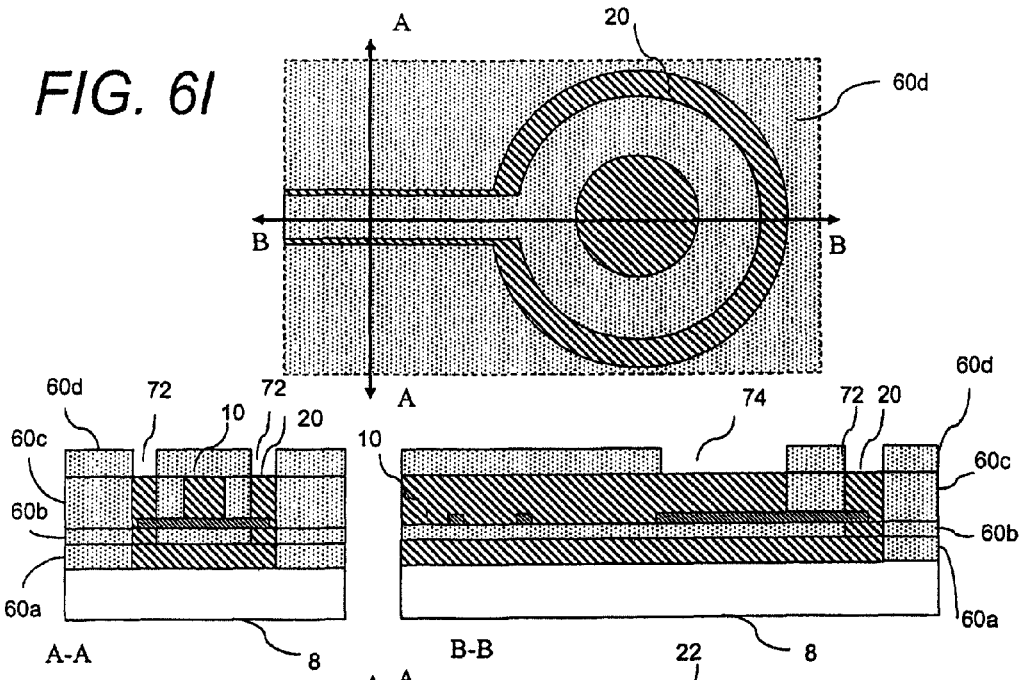

With reference to FIG. 6I, a fourth sacrificial material layer 60*d* is deposited over the substrate, and is exposed and developed to form pattern 72 for subsequent deposition of upper sidewall portions of the outer conductor for the transmission line main region and transition structure. The pattern 72 for the upper sidewall portion includes a channel coextensive with and exposing the middle sidewall portion 20. At the same time, pattern 74 is formed for subsequent deposition of a conductive layer on that portion of the center conductor end portion which is to be joined to the electrical connector. Such conductive layer allows for a coplanar center and outer conductor contact surface in the transition structure. Conventional photolithography steps and materials as described above can be used for this purpose.

Figure 6J:
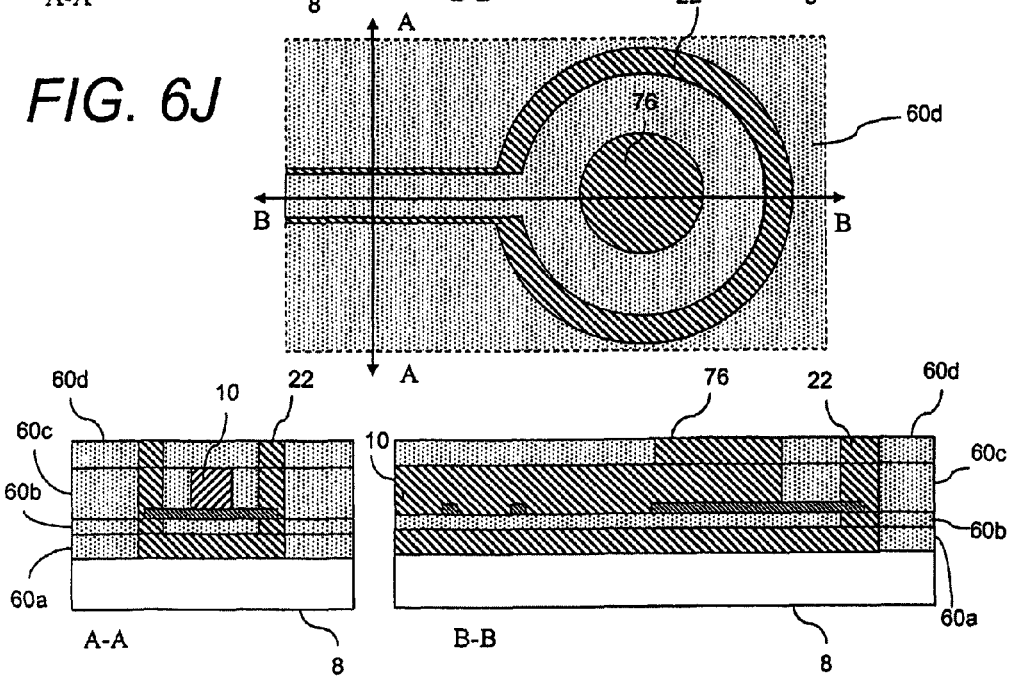

As illustrated in FIG. 6J, upper sidewall portions 22 of the outer conductor in the transmission line main region and transition structure, and an additional layer 76 on the center conductor end portion, are next formed by depositing a suitable material into the channels formed in the fourth sacrificial layer 60*d*. Appropriate materials and techniques for forming these structures are the same as those mentioned above with respect to the base layer and other sidewall and center conductor portions. The upper sidewall portions 22 and center conductor end portion layer 76 are typically formed with the same materials and techniques used in forming the base layer and other sidewalls and center conductor portions, although different materials and/or techniques may be employed. Surface planarization can optionally be performed at this stage to remove any unwanted metal deposited on the top surface of the sacrificial material in addition to providing a flat surface for subsequent processing.

Figure 6K:
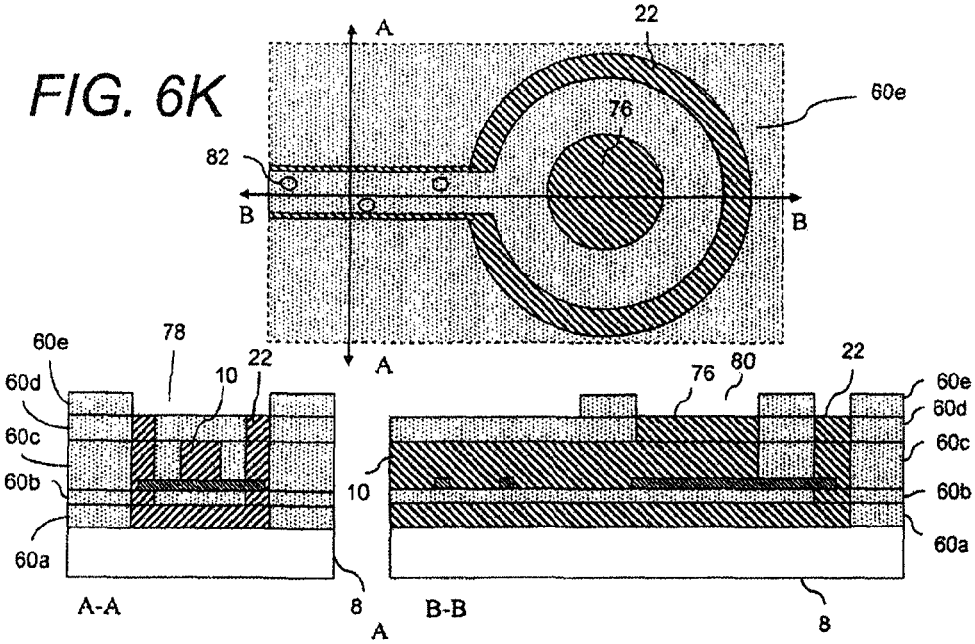
Figure 6L:
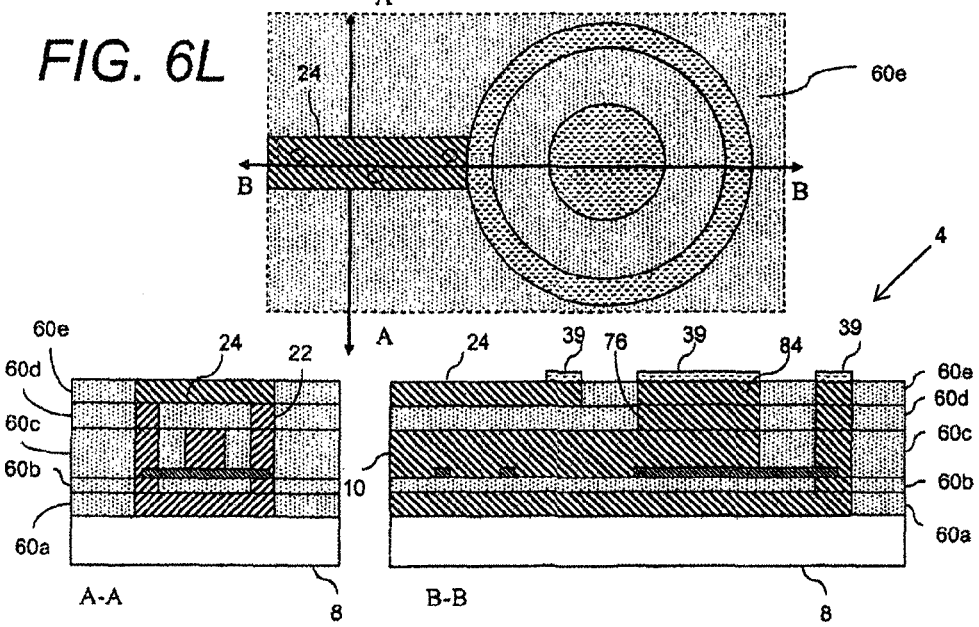

With reference to FIG. 6K, a fifth photosensitive sacrificial layer 60*e* is deposited over the substrate, and is exposed and developed to form patterns 78, 80 for subsequent deposition of the top wall of the transmission line outer conductor and a conductive layer on the previously formed layer of the center conductor end portion. The pattern 78 for the top wall exposes the upper sidewall portions 22 and the fourth sacrificial material layer 60*d* therebetween. The pattern 80 for the center conductor end portion exposes the previously formed center conductor end portion layer 76. In patterning the sacrificial layer 60*e*, it may be desirable to leave one or more regions 82 of the sacrificial material in the area between the upper sidewall portions. In these regions, metal deposition is prevented during subsequent formation of the outer conductor top wall. As described below, this will results in openings in the outer conductor top wall facilitating removal of the sacrificial material from the microstructure. Such openings are represented as circles 82, but may be squares, rectangles or other shapes. Further, while such openings are shown in the top layer, they may be included in any layer to improve the flow of solution to aid in removal of the sacrificial material later in the process. The shape, size and locations are chosen based on design principles that include maintaining the desired mechanical integrity, maintaining sufficiently low radiation and scattering losses for the intended frequencies of operation, based on where the electrical fields are the lowest if being designed for low loss propagation, which is typically the corners of the coaxial structure, and based on sufficient fluid flow to remove the sacrificial material As shown in FIG. 6L, the upper wall 24 of the outer conductor is next formed by depositing a suitable material into the exposed region over and between the upper sidewall portions 22 of the transmission line main region. At the same time, a further conductive layer 84 is formed on the end portion of the center conductor over layer 76. These layers are formed by depositing a suitable material into the channels formed in the fifth sacrificial layer 60*e*. Metallization is prevented at least in the volume occupied by the sacrificial material regions 82, for example illustrated in an aspect of embodiments at least in FIG. 6K. Appropriate materials and techniques for forming these conductive structures are the same as those mentioned above with respect to the base layer and other sidewall and center conductor layers, although different materials and/or techniques may be employed. Surface planarization can optionally be performed at this stage.

To allow for bonding of the electrical connector 6 to the transition structure 4, one or more solderable layers 39 may be formed on the bonding surfaces of the transition structure as shown in FIG. 1A. The solderable layer may be formed in the same manner described above for the other conductive layers, using a further patterned layer of the sacrificial material followed by metallization, or other metallization technique such as by vapor deposition of the solder and use of a lift-off resist or shadow mask or by use of selective deposition. The solderable layer may include, for example, an Au—Sn solder or other solder material. The thickness of the solderable layers will depend on the particular materials involved, as well as the dimensions of the microstructure and of the connector. Other structures and techniques for affixing the connector to the transition structure are envisioned, for example, using conductive epoxies, nanoparticle based adhesives, anisotropic conductive adhesives, or a mechanical snap- or thread-type connector which may be repeatedly connected and disconnected.

With the basic structure of the transmission line being complete, additional layers may be added, for example, to create additional transmission lines or waveguides that may be interconnected to the first exemplary layer. Other layers such as the solders may optionally be added.

Once the construction is complete, the sacrificial material remaining in the structure may next be removed. The sacrificial material may be removed by known strippers based on the type of material used. Suitable strippers include, for example: commercial stripping solutions such as Surfacestrip™ 406-1, Surfacestrip™. 446-1, or Surfacestrip™ 448 (Rohm and Haas Electronic Materials); aqueous solutions of strong bases such as sodium hydroxide, potassium hydroxide, or tetramethylammonium hydroxide; aqueous solutions of strong bases containing ethanol or monoethanolamine; aqueous solutions of strong bases containing ethanol or monoethanolamine and a strong solvent such as N-methylpyrrolidone or N,N-dimethylformamide; and aqueous solutions of tetramethylammonium hydroxide, N-methylpyrrolidone and monoethanolamine or ethanol.

In order for the material to be removed from the microstructure, the stripper is brought into contact with the sacrificial material. The sacrificial material may be exposed at the end faces of the transmission line structure. Additional openings in the transmission line such as described above may be provided to facilitate contact between the stripper and sacrificial material throughout the structure. Other structures for allowing contact between the sacrificial material and stripper are envisioned. For example, openings can be formed in the transmission line sidewalls during the patterning process. The dimensions of these openings may be selected to minimize interference with, scattering or leakage of the guided wave. The dimensions can, for example, be selected to be less than ⅛, 1/10 or 1/20 of the wavelength of the highest frequency used. The impact of such openings can readily be calculated and can be optimized using software such as HFSS made by Ansoft, Inc.

Figure 6M:
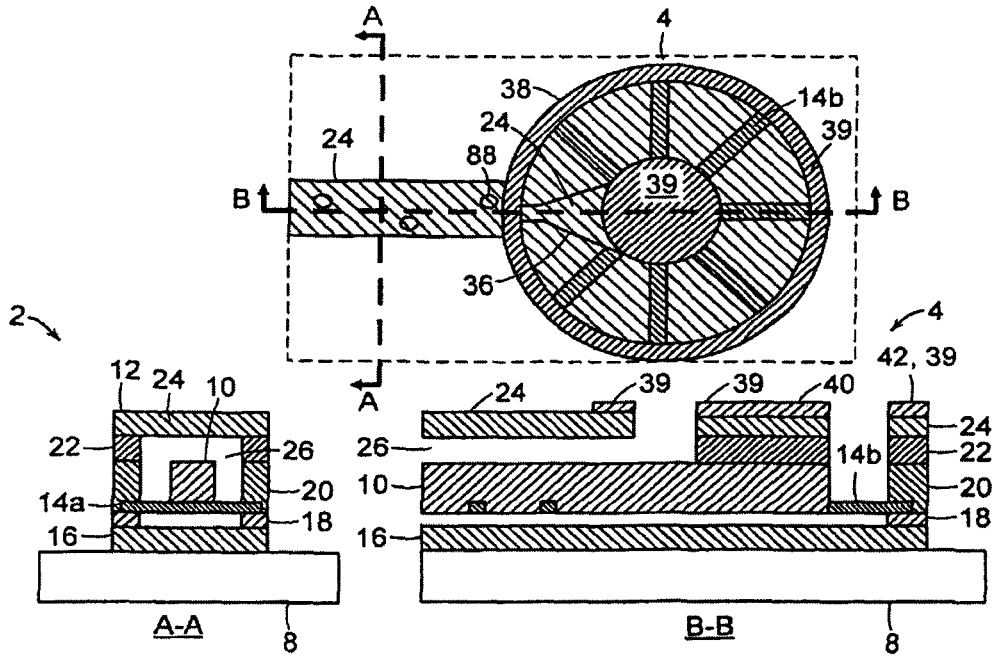

The final transmission line microstructure 2 after removal of the sacrificial resist is shown in FIG. 6M. The volume previously occupied by the sacrificial material in and within the outer walls of the transmission line forms apertures 88 in the outer conductor and forms the transmission line core 26. The core volume is typically occupied by a gas such as air. It is envisioned that a gas having better dielectric properties than air, for example, sulfur hexafluoride, may be used in the core. Optionally, a vacuum can be created in the core, for example, when the structure forms part of a hermetic package. As a result, a reduction in absorption from water vapor that may otherwise adsorb to the surfaces of the transmission lines can be realized. It is further envisioned that a liquid can occupy the core volume 26 between the center conductor and outer conductor, for example for cooling.

The connector 6, for example illustrated in an aspect of embodiments at least at FIG. 1A, may next be attached to the transition structure 4. Such attachment may be conducted by aligning the center and outer conductor mating surfaces of the connector with the corresponding structures of the transition structure, and forming a solder joint by heating. In this case a solder film or solder ball can be applied to either or both of the connector and microstructure mating surfaces. For example, a thin film solder such as Au—Sn (80:20) solder may be used to join the parts. Typically, a solder flow wick-stop layer may be applied to the microstructure surrounding the region where solder will be applied for attachment. This can be achieved, for example, with use of a nickel film that is patterned in and surrounding the region to be soldered. An inner wetting layer is patterned on the nickel, for example, a gold layer. The gold layer allows the solder to wet to where it is patterned. The surrounding nickel film will, however, prevent the solder from flowing onto other regions of the microstructure due to the formation of nickel oxides. Other methods of stopping the solder from wicking may be employed. For example, formation of a surrounding dielectric ring such as a permanent photopolymer as described with reference to the dielectric support layer may be employed. Other methods to control the flow of solder are known in the art.

Bonding of the connector to the transition structure may optionally be conducted with the use of a conductive adhesive, for example, a silver-filled epoxy or nano-sized metal particle paste. Conductive adhesives are also available as an anisotropic conductive film or paste, wherein the conductive particle film or paste conduct only in one direction. The direction is determined by, for example, application of pressure or a magnetic field. This approach allows an easier method to align the connector and the microstructure as overflow of the material into surrounding regions will not produce electrical shorting.

For certain applications, it may be beneficial to separate the final transmission line microstructure from the substrate to which it is attached. This may be done prior to or after attachment of the connector. Release of the transmission line microstructure would allow for coupling to another substrate, for example, a gallium arsenide die such as a monolithic microwave integrated circuits or other devices. Such release also allows structures such as connectors and antennae to be on opposite sides of the microstructure without the need to machine through a substrate material. As shown previously in FIG. 4A-4C, released microstructures 48 can be joined to a separate substrate 50, for example illustrated in an aspect of embodiments at least in FIG. 4C, designed to provide additional support to the transition structure in the form of a pedestal. A released microstructure with connectors can offer other advantages, such as smaller thickness profiles, application of the completed microstructure to separately made die or wafers of active devices, and connectorization of both opposing surfaces of the microstructure. Release of the structure from the substrate may be accomplished by various techniques, for example, by use of a sacrificial layer between the substrate and the base layer which can be removed upon completion of the structure in a suitable solvent or etchant that does not attack or is sufficiently selective to the structural materials chosen. Suitable materials for the sacrificial layer include, for example, photoresists, selectively etchable metals such as chrome or titanium, high temperature waxes, and various salts.

While the exemplified transmission lines include a center conductor formed over the dielectric support members 14*a*, 14*b*, it is envisioned that they can be disposed within the center conductor such as in a split center conductor using a geometry such as a plus (+)-shape, a T-shape or a box. The support members 14*a* may be formed over the center conductor in addition or as an alternative to the underlying dielectric support members. Further, the support members 14*a*, 14*b* may take the form of a pedestal, providing support from any of the surrounding surfaces when placed between a center conductor and a surrounding surface.

Figure 7:
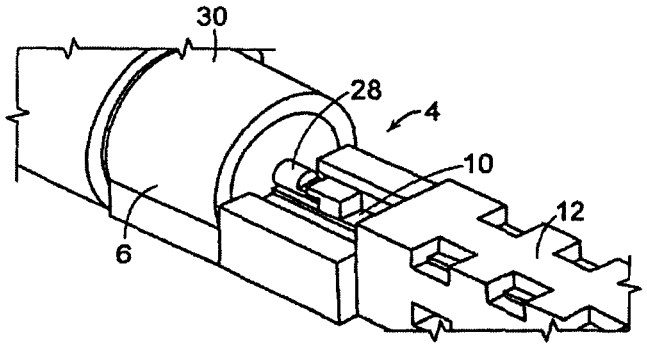
FIG. 7 illustrates a perspective view of an exemplary coaxial transmission line microstructure in accordance with a further aspect of the invention.

FIG. 7 shows an alternative exemplary embodiment of the transmission line microstructure of the invention. In this device, the transition structure 4 is interfaced to a microwave connector 6 on the same axis rather than perpendicular to each other. In this case, a similar low loss transition region from the coaxial transmission line dimensions up to the dimensions of the connector center conductor 28 can be made. The transition structure is designed to either stop in-line with and adjacent to the center conductor 28 of the connector, allowing a wedge bond or wire bond interface, or allowing a solder or conductive epoxy connection. Alternatively, the center conductor transition of the coaxial waveguide may be formed into a mating structure to receive the connector's center conductor where it may be attached with solder or conductive adhesive. The outer conductor 30 of the connector is held either in a housing such as a metal block, or may be housed directly in a structured sidewall of the microstructure using the same basic processes that form the coaxial waveguide microstructure. The outer conductor of the connector may be attached using solder or conductive epoxy. It may also be retained by creating a clam-shell two piece construction that mechanically retains the connector in the housing. Other approaches known in the art may be used to attach and retain the in-line connector.

The transmission lines of the invention typically are square in cross-section. Other shapes, however, are envisioned. For example, other rectangular transmission lines can be obtained in the same manner the square transmission lines are formed, except making the width and height of the transmission lines different. Rounded transmission lines, for example, circular or partially rounded transmission lines can be formed by use of gray-scale patterning. Such rounded transmission lines can, for example, be created through conventional lithography for vertical transitions and might be used to more readily interface with external micro-coaxial conductors, to make connector interfaces, etc.

A plurality of transmission lines as described above may be formed in a stacked arrangement, with the understanding that the transition structure would typically be disposed so that the connector structure can make electrical contact with the transition structure. The stacked arrangement can be achieved by continuation of the sequential build process through each stack, or by preforming the transmission lines on individual substrates, separating transmission line structures from their respective substrates using a release layer, and stacking the structures. Such stacked structures can be joined by thin layers of solders or conductive adhesives. In theory, there is not a limit on the number of transmission lines that can be stacked using the process steps discussed herein. In practice, however, the number of layers will be limited by the ability to manage the thicknesses and stresses and, if they are built monolithically, the resist removal associated with each additional layer. While coaxial waveguide microstructures have been shown in the exemplified devices, the structures such as hollow-core waveguides, antenna elements, cavities, and so forth can also be constructed using the described methods and may be interspersed with the connector shown.

While some of the illustrated transmission line microstructures show a single transmission line and connector, it should be clear that a plurality of such transmission lines each to be joined to a plurality of connectors are typical. Further, such structures are typically manufactured on a wafer- or grid-level as a plurality of die. The microstructures and methods of the invention find use, for example, in: microwave and millimeter wave active and passive components and subsystems, in microwave amplifiers, in satellite communications, in data and telecommunications such as point to point data links, in microwave and millimeter wave filters and couplers; in aerospace and military applications, in radar and collision avoidance systems, and communications systems; in automotive pressure and/or rollover sensors; chemistry in mass spectrometers and filters; biotechnology and biomedical in filters, in wafer or grid level electrical probing, in gyroscopes and accelerometers, in microfluidic devices, in surgical instruments and blood pressure sensing, in air flow and hearing aid sensors; and consumer electronics such as in image stabilizers, altitude sensors, and autofocus sensors.

While the invention has been described in detail with reference to specific embodiments thereof, it will be apparent to one skilled in the art that various changes and modifications can be made, and equivalents employed, without departing from the scope of the claims.

What is claimed is:

1. A transmission line microstructure for connection to a cylindrical coaxial cable, comprising:

a rectangular coaxial microstructure having a center conductor surrounded by an outer conductor extending along a longitudinal axis, the outer conductor including a plurality of layers of a conductive material, the center conductor having an end with a step change in thickness perpendicular to the longitudinal axis; and a transition structure electrically connected to the outer conductor of the rectangular coaxial microstructure proximate the center conductor end said transition structure having a step change in height, and extending outwardly therefrom along the longitudinal axis, the transition structure having an upper surface shaped to support a cylindrical coaxial cable at an orientation in which a center conductor of the cylindrical coaxial cable is disposed along the longitudinal axis in electrical communication with the center conductor of the rectangular coaxial microstructure.

2. A connectorized coaxial transmission line microstructure, comprising the transmission line microstructure of claim 1 and an connector electrically connected to the center conductor and the outer conductor via the transition structure.

3. The transmission line microstructure of claim 1, comprising one or more dielectric support members for supporting the center conductor with respect to the outer conductor.

4. The transmission line microstructure of claim 1, comprising a non-solid volume disposed between the center conductor and the outer conductor.

5. The transmission line microstructure of claim 1, wherein the center conductor comprises a plurality of layers of a conductive material.

6. A method of forming a transmission line microstructure, comprising:

sequentially disposing a plurality of layers over a substrate, wherein the plurality of layers comprise one or more of dielectric, conductive, and sacrificial materials; and forming from the plurality of layers:

i) a rectangular coaxial microstructure having a center conductor surrounded by an outer conductor extending along a longitudinal axis, the outer conductor including the plurality of layers comprised of said conductive material, the center conductor having an end with a step change in thickness perpendicular to the longitudinal axis; and ii) a transition structure electrically connected to the outer conductor of the rectangular coaxial microstructure proximate the center conductor end said transition structure having a step change in height, and extending outwardly therefrom along the longitudinal axis, the transition structure having an upper surface shaped to support a cylindrical coaxial cable at an orientation in which a center conductor of the cylindrical coaxial cable is disposed along the longitudinal axis in electrical communication with the center conductor of the rectangular coaxial microstructure.

7. The method of claim 6, comprising the step of removing the sacrificial material to provide a non-solid volume between the center conductor and the outer conductor.

8. The method of claim 6, wherein the sequential depositing of the conductive material comprises one or more of plating, physical vapor deposition, screen printing, and chemical vapor deposition.

9. The method of claim 6, comprising the step of removing the transmission line microstructure from the substrate.

* * * * *